US009297057B2

(12) United States Patent
Yoon et al.

(10) Patent No.: US 9,297,057 B2
(45) Date of Patent: Mar. 29, 2016

(54) COLD ROLLED STEEL SHEET HAVING AGING RESISTANCE AND SUPERIOR FORMABILITY, AND PROCESS FOR PRODUCING THE SAME

(75) Inventors: Jeong-Bong Yoon, Pohang (KR); Won-Ho Son, Pohang (KR); Ki-Bong Kang, Pohang (KR); Noi-Ha Cho, Dongkwangyang (KR); Ki-Duck Park, Dongkwangyang (KR)

(73) Assignee: POSCO, Pohang-si (KR)

( * ) Notice: Subject to any disclaimer, the term of this patent is extended or adjusted under 35 U.S.C. 154(b) by 1377 days.

(21) Appl. No.: 10/578,737

(22) PCT Filed: Nov. 10, 2004

(86) PCT No.: PCT/KR2004/002901

§ 371 (c)(1),
(2), (4) Date: May 10, 2006

(87) PCT Pub. No.: WO2005/045085

PCT Pub. Date: May 19, 2005

(65) Prior Publication Data

US 2009/0020196 A1 Jan. 22, 2009

(30) Foreign Application Priority Data

| | | |
|---|---|---|
| Nov. 10, 2003 | (KR) | 10-2003-0079050 |
| Nov. 19, 2003 | (KR) | 10-2003-0082135 |
| Dec. 4, 2003 | (KR) | 10-2003-0087534 |
| Dec. 4, 2003 | (KR) | 10-2003-0087566 |
| Dec. 4, 2003 | (KR) | 10-2003-0087595 |
| Dec. 5, 2003 | (KR) | 10-2003-0088134 |
| Dec. 8, 2003 | (KR) | 10-2003-0088513 |
| Dec. 8, 2003 | (KR) | 10-2003-0088521 |
| Dec. 8, 2003 | (KR) | 10-2003-0088689 |
| Dec. 22, 2003 | (KR) | 10-2003-0094485 |
| Dec. 29, 2003 | (KR) | 10-2003-0099352 |
| Dec. 29, 2003 | (KR) | 10-2003-0099436 |
| Jun. 7, 2004 | (KR) | 10-2004-0041509 |
| Jun. 7, 2004 | (KR) | 10-2004-0041510 |
| Jun. 7, 2004 | (KR) | 10-2004-0041511 |
| Aug. 24, 2004 | (KR) | 10-2004-0066620 |
| Sep. 6, 2004 | (KR) | 10-2004-0070959 |
| Sep. 6, 2004 | (KR) | 10-2004-0070960 |
| Oct. 6, 2004 | (KR) | 10-2004-0079664 |
| Oct. 21, 2004 | (KR) | 10-2004-0084298 |

(51) Int. Cl.

| | |
|---|---|
| ***C21D 8/02*** | (2006.01) |
| ***C22C 38/00*** | (2006.01) |
| ***C21D 9/52*** | (2006.01) |
| ***C22C 38/04*** | (2006.01) |

(52) U.S. Cl.

CPC ..... *C22C 38/004* (2013.01); *C21D 8/0205* (2013.01); *C21D 9/52* (2013.01); *C22C 38/04* (2013.01)

(58) Field of Classification Search

CPC ..... C21D 8/0205; C21D 9/52; C22C 38/004; C22C 38/04

USPC ..... 148/603

See application file for complete search history.

(56) References Cited

U.S. PATENT DOCUMENTS

| | | | | |
|---|---|---|---|---|
| 3,879,232 | A * | 4/1975 | Gondo et al. | 148/505 |
| 4,908,073 | A | 3/1990 | Sato et al. | |
| 6,524,726 | B1 | 2/2003 | Kitano et al. | |
| 6,706,419 | B2 | 3/2004 | Yoshinaga et al. | |
| 2003/0061908 | A1 | 4/2003 | Nabeshima et al. | |
| 2003/0196735 | A1 * | 10/2003 | Sugiura et al. | 148/602 |

FOREIGN PATENT DOCUMENTS

| | | | |
|---|---|---|---|
| JP | 58025436 | A | 2/1983 |
| JP | 2200754 | A | 8/1990 |
| JP | 5171285 | A | 7/1993 |
| JP | 5287446 | A | 11/1993 |
| JP | 6017141 | A | 1/1994 |
| JP | 6093376 | A | 4/1994 |
| JP | 6093377 | A | 4/1994 |

(Continued)

OTHER PUBLICATIONS

Machine translation of JP 10-158782.*

(Continued)

*Primary Examiner* — Jessee Roe

*Assistant Examiner* — Christopher Kessler

(74) *Attorney, Agent, or Firm* — The Webb Law Firm

(57) ABSTRACT

A cold rolled steel sheet, and a method of manufacturing the same, designed to have aging resistance and excellent formability suitable for use in automobile bodies, electronic appliances, and the like. The cold rolled steel sheet comprises in weight %: 0.003% or less of C, 0.003~0.03% of S, 0.01~0.1% of Al, 0.02% or less of N, 0.2% or less of P, at least one of 0.03~0.2% of Mn and 0.005~0.2% of Cu, and a balance of Fe and other unavoidable impurities. When the steel sheet comprises one of Mn and Cu, the composition of Mn, Cu, and S satisfies at least one relationship: $0.58*Mn/S \leq 10$ and $1 \leq 0.5*Cu/S \leq 10$, and when the steel sheet comprises both Mn and Cu, the composition of Mn, Cu, and S satisfies the relationship: $Mn+Cu \leq 0.3$ and $2 \leq 0.5*(Mn+Cu)/S \leq 20$. Participates of MnS, CuS, and (Mn, Cu)S in the steel sheet have an average size of 0.2 μm or less. Since carbon content in a solid solution state in a crystal grain is controlled by fine precipitates of MnS, CuS, or (Mn, Cu)S, the steel sheet has enhanced aging resistance and formability, and has excellent yield strength and strength-ductility.

41 Claims, 5 Drawing Sheets

(56) References Cited

FOREIGN PATENT DOCUMENTS

| | | | |
|---|---|---|---|
| JP | 6212354 | A | 8/1994 |
| JP | 8020839 | A | 1/1996 |
| JP | 9031598 | A | 2/1997 |
| JP | 9067653 | A | 3/1997 |
| JP | 10158782 | A | 6/1998 |
| JP | 2002053933 | A | 2/2002 |
| JP | 2002266016 | A | 9/2002 |
| JP | 2003096543 | A | 4/2003 |
| JP | 2004143470 | A | 5/2004 |
| JP | 2005036247 | A | 2/2005 |
| KR | 20000039137 | A | 7/2000 |
| KR | 20010060768 | A | 7/2001 |
| KR | 20020049667 | A | 6/2002 |
| KR | 20030053770 | A | 7/2003 |
| WO | WO 03031670 | A1 * | 4/2003 |
| WO | 2005061748 | A1 | 7/2005 |

OTHER PUBLICATIONS

Nutting, J and Viswanathan, R., "Clean Steel: Superclean Steel", Conference Proceedings, Mar. 6-7, 1995, 33 pp., (1996) The Institute of Materials, London, UK.

* cited by examiner

COLD ROLLED STEEL SHEET HAVING AGING RESISTANCE AND SUPERIOR FORMABILITY, AND PROCESS FOR PRODUCING THE SAME

TECHNICAL FIELD

The present invention relates to cold rolled steel sheets primarily suitable for use in automobile bodies, electronic appliances, and the like. More particularly, the present invention relates to cold rolled steel sheets, improved in aging resistance and formability by controlling a critical value of carbon content in a solid solution state in a crystal grain by use of fine precipitates, and a method of manufacturing the same.

BACKGROUND ART

Aging resistance is required for cold rolled steel sheets used for automobile bodies, electronic appliances, and the like, together with a high strength and formability thereof. The term "aging" refers to a strain aging phenomenon, which causes a defect, what is called "stretcher strain", caused by hardening occurring when solid solution elements, such as C and N, are fixed to dislocations.

Aging resistance can be imparted upon the cold rolled steel sheets through batch annealing of aluminum-killed steels. However, batch annealing requires an extended annealing time, thereby reducing productivity, and causing severe variation in mechanical properties depending on positions on the steel sheet. Accordingly, interstitial free (IF) steel is mainly used, which is produced by adding intensive carbide or nitride-forming elements, such as Ti or Nb, followed by continuous annealing.

In order to produce the IF steel, the intensive carbide or nitride-forming elements, such as Ti or Nb, must be added. With regard to this, since these elements are likely to raise the recrystallization temperature, the continuous annealing must be performed at a high temperature. As a result, such a process for manufacturing the IF steel causes a decrease in productivity, an increase in manufacturing costs due to large energy consumption, and severe environmental problems. Moreover, the high temperature annealing typically causes various defects, such as cracks, deformation, and the like.

Furthermore, since Ti and Nb have an intensive oxidizing property, these elements generate a great number of non-metallic inclusions, causing surface defects on the steel sheet. Additionally, IF steel has fragile grain boundaries, and is thus subject to, what is so called, "a secondary work embrittlement," which causes embrittlement of the steel sheet after forming. In order to prevent the secondary work embrittlement, elements including B are added. Meanwhile, in the case where IF steel is used for the products subjected to surface treatments, such as plating, coating and the like, lots of defects typically occur on the surface of the products.

In order to solve the problems, steel without Ti or Nb has been suggested. As an example, Japanese Patent Laid-open Publications No. (Hei) 6-093376, 6-093377, and 6-212354 disclose a method of improving aging resistance of steel sheets by means of strict control of carbon content within a range of 0.0001~0.0015 wt %, in which B is added in a range of 0.0001~0.003 wt % instead of Ti or Nb.

According to the above disclosures, since the aging resistance cannot be sufficiently ensured, quenching is needed after annealing the steel in order to ensure the aging resistance. However, in this case, there is a problem in that the quenching is usually performed as a water quench in a water bath, creating an oxidized coat on the steel sheet, and is thus accompanied with pickling in order to remove the oxidized coat, thereby causing the surface defects on the steel sheet, which require additional manufacturing costs. Moreover, the steel sheet has a low strength. Additionally, since the steel sheet has poor in-plane anisotropy, creating wrinkles and ears on the steel sheet, the method suffers from large material consumption.

Meanwhile, the inventors of the present invention have suggested a method of manufacturing cold rolled steel sheets having excellent stretching formability with improved ductility without adding Ti or Nb, disclosed in Korean Patent Laid-open Publication No. 2000-0039137. The method comprises the steps of: hot-rolling a steel slab with finish rolling at an Ar3 transformation temperature or more to provide a hot rolled steel sheet, the steel slab comprising, in terms of weight %: 0.0005~0.002% of C, 0.05~0.03% of Mn, 0.015% or less of P, 0.01~0.08% of Al; 0.001~0.005% of N; and the balance of Fe and other unavoidable impurities, wherein the composition of C, N, S, and P satisfies the relationship: C+N+S+P≤0.025%; coiling the steel sheet at a temperature of 750° C. or less; cold rolling the wound steel sheet at a reduction rate of 50~90%; and continuous annealing the cold rolled steel sheet at a temperature of 650~850° C. for 10 seconds or more. The cold rolled steel sheet manufactured by the method has excellent ductility while ensuring the aging resistance. However, according to the method of the disclosure, since the C content, the N content, the S content, and the P content must be controlled to satisfy the relationship: C+N+S+P≤0.025% in the cold rolled steel sheet, it is necessary to intensify desulphurization capability and dephosphorylation capability during a manufacturing process, thereby causing problems in productivity and manufacturing costs. In view of mechanical properties, since the yield strength of the finally manufactured steel sheet is excessively low, it is necessary to use a relatively thick material. Additionally, upon processing, there is a problem in that due to an excessively high in-plane anisotropy index (Δr), excessive wrinkles are created on the steel sheet, causing fracture of the steel sheet.

The inventors of the present invention have also suggested a method of manufacturing a cold rolled steel sheet, which can improve the yield strength of high strength steel having a 340 MPa grade-tensile strength, disclosed in Korean Patent Laid-open Publication No. 2002-0049667. The method comprises the steps of: hot-rolling a steel slab at an $Ar_3$ transformation temperature or more to provide a hot rolled steel sheet, the steel slab comprising, in terms of weight %: 0.0005~0.003% of C, 0.1% or less of Mn, 0.003~0.02% of S, 0.03~0.07% of P, 0.01~0.1% of Al, 0.005% or less of N, and 0.05~0.3% of Cu, wherein the atomic ratio of Cu/S is 2~10; cold rolling the wound steel sheet at a reduction rate of 50~90%; and continuous annealing the cold rolled steel sheet at a temperature of 700~880° C. for 10 seconds to 5 minutes. The cold rolled steel sheet manufactured by the method has an improved yield strength of 240 MPa in a 340 MPa-grade high tensile strength steel. However, since the aging index of the steel sheet is greater than 30 MPa, the aging resistance cannot be ensured for this steel sheet, and since the steel sheet has a high in-plane anisotropy index (Δr) of 0.5 or more at a plasticity-anisotropy index ($r_m$) of 1.8 level, excessive wrinkles are created on the steel sheet, causing the fracture of the steel sheet.

Meanwhile, a cold rolled steel sheet is known in the prior art, which is a high strength cold rolled steel sheet having the aging resistance, and which is manufactured by adding 0.3~0.7% of Mn and Ti to an extremely low carbon steel while increasing a phosphorus content in the carbon steel. The cold rolled steel sheet has a ductility-brittleness transition temperature of 0~30° C.; that is, the cold rolled steel sheet has poor secondary work embrittlement to the extent that causes the fracture at a room temperature upon impact.

SUMMARY OF THE INVENTION

Therefore, the present invention has been made in view of the above problems, and it is an object of the present invention to provide a cold rolled steel sheet, having improved formability and aging resistance without adding Ti or Nb, and a method of manufacturing the same.

It is another object of the present invention to provide a cold rolled steel sheet, having excellent yield strength, strength-ductility balance characteristics, secondary work embrittlement resistance, and low in-plane anisotropy while having a plasticity-anisotropy index of a predetermined level or more, and a method of manufacturing the same.

In accordance with the present invention, the above and other objects can be accomplished by the provision of a cold rolled steel sheet, comprising in weight %: 0.003% or less of C; 0.003~0.03% of S; 0.01~0.1% of Al; 0.02% or less of N; 0.2% or less of P; at least one of 0.03~0.2% of Mn and 0.005~0.2% of Cu; and the balance of Fe and other unavoidable impurities, wherein, when the steel sheet comprises one of Mn and Cu, the composition of Mn, Cu, and S satisfies one of the relationships: $0.58*Mn/S \leq 10$ and $1 \leq 0.5*Cu/S \leq 10$, and when the steel sheet comprises both Mn and Cu, the composition of Mn, Cu, and S satisfies the relationships: $Mn+Cu \leq 0.3$ and $2 \leq 0.5*(Mn+Cu)/S \leq 20$, and wherein precipitates of MnS, CuS, and (Mn, Cu)S have an average size of 0.2 μm or less. As used above and throughout the specification and claims, the asterisk symbol "*" used in the Mn, Cu and S relationships is a symbol for multiplication.

The cold rolled steel sheet of the invention can be classified in accordance with at least one additive selected from the group consisting of Mn and Cu; that is, (1) Mn solely-added steel (Cu excluded, which will also be referred to as "MnS-precipitated steel"), (2) Cu solely-added steel (Mn excluded, which will also be referred to as "CuS-precipitated steel"), and (3) Mn and Cu added steel (which will also be referred to as "MnCu-precipitated steel"), which will be described in detail as follows.

(1) The MnS-precipitated steel comprises: 0.003% or less of C; 0.005~0.03% of S; 0.01~0.1% of Al; 0.02% or less of N; 0.2% or less of P; 0.05~0.2% of Mn; and the balance of Fe and other unavoidable impurities, in terms of weight %, wherein the composition of Mn and S satisfies the relationship: $0.58*Mn/S \leq 10$, and precipitates of MnS have an average size of 0.2 μm or less. A method of manufacturing MnS-precipitated steel comprises the steps of: hot-rolling a steel slab with finish rolling at an Ar3 transformation temperature or more to provide a hot rolled steel sheet, after reheating the steel slab to a temperature of 1,100° C. or more, the steel slab comprising: 0.003% or less of C; 0.005~0.03% of S; 0.01~0.1% of Al; 0.02% or less of N; 0.2% or less of P; 0.05~0.2% of Mn; and the balance of Fe and other unavoidable impurities, in terms of weight %, wherein the composition of Mn and S satisfies the relationship: $0.58*Mn/S \leq 10$; cooling the steel sheet at a speed of 200° C./min or more; coiling the cooled steel sheet at a temperature of 700° C. or less; cold rolling the wound steel sheet; and continuous annealing the cold rolled steel sheet.

(2) The CuS-precipitated steel comprises: 0.0005~0.003% of C; 0.003~0.025% of S; 0.01~0.08% of Al; 0.02% or less of N; 0.2% or less of P; 0.01~0.2% of Cu; and the balance of Fe and other unavoidable impurities, in terms of weight %, wherein the composition of Cu and S satisfies the relationship: $1 \leq 0.5*Cu/S \leq 10$, and precipitates of CuS have an average size of 0.1 μm or less. A method of manufacturing CuS-precipitated steel comprises the steps of: hot-rolling a steel slab with finish rolling at an Ar3 transformation temperature or more to provide a hot rolled steel sheet, after reheating the steel slab to a temperature of 1,100° C. or more, the steel slab comprising 0.0005~0.003% of C; 0.003~0.025% of S; 0.01~0.08% of Al; 0.02% or less of N; 0.2% or less of P; 0.01~0.2% of Cu; and the balance of Fe and other unavoidable impurities, in terms of weight %, wherein the composition of Cu and S satisfies the relationship: $1 \leq 0.5*Cu/S \leq 10$; cooling the steel sheet at a speed of 300° C./min; coiling the cooled steel sheet at a temperature of 700° C. or less; cold rolling the wound steel sheet; and continuous annealing the cold rolled steel sheet.

(3) The MnCu-precipitated steel comprises: 0.0005~0.003% of C; 0.003~0.025% of S; 0.01~0.08% of Al; 0.02% or less of N; 0.2% or less of P; 0.03~0.2% of Mn; 0.005~0.2% of Cu; and the balance of Fe and other unavoidable impurities, in terms of weight %, wherein the composition of Mn, Cu, and S satisfies the relationships: $Mn+Cu \leq 0.3$ and $2 \leq 0.5*(Mn+Cu)/S \leq 20$, and wherein precipitates of MnS, CuS, and (Mn, Cu)S have an average size of 0.2 μm or less. A method of manufacturing MnCu-precipitated steel comprises the steps of: hot-rolling a steel slab with finish rolling at an Ar3 transformation temperature or more to provide a hot rolled steel sheet, after reheating the steel slab to a temperature of 1,100° C. or more, the steel slab comprising: 0.0005~0.003% of C; 0.003~0.025% of S; 0.01~0.08% of Al; 0.02% or less of N; 0.2% or less of P; 0.03~0.2% of Mn; 0.005~0.2% of Cu; and the balance of Fe and other unavoidable impurities, in terms of weight %, wherein the composition of Mn, Cu, and S satisfies the relationships: $Mn+Cu \leq 0.3$ and $2 \leq 0.5*(Mn+Cu)/S \leq 20$; cooling the steel sheet at a speed of 300° C./min; coiling the cooled steel sheet at a temperature of 700° C. or less; cold rolling the wound steel sheet; and continuous annealing the cold rolled steel sheet.

The above described cold rolled steel sheet is preferably applied to ductile cold rolled steel sheets having a 240 MPa-grade tensile strength of or to high strength cold rolled steel sheets having a 340 MPa-grade or more tensile strength.

In the case of the ductile cold rolled steel sheets in a 240 MPa-grade, the steel sheet comprises 0.003% or less of C, 0.003~0.03% of S; 0.01~0.1% of Al; 0.004% or less of N; 0.015% or less of P; at least one of 0.03~0.2% of Mn and 0.005~0.2% of Cu; and the balance of Fe and other unavoidable impurities, in terms of weight %, wherein, when the steel sheet comprises one of Mn and Cu, the composition of Mn, Cu, and S satisfies one of the relationships: $0.58*Mn/S \leq 10$ and $1 \leq 0.5*Cu/S \leq 10$, and when the steel sheet comprises both Mn and Cu, the composition of Mn, Cu, and S satisfies the relationship: $Mn+Cu \leq 0.3$ and $2 \leq 0.5*(Mn+Cu)/S \leq 20$, and wherein the precipitates of MnS, CuS, and (Mn, Cu)S have an average size of 0.2 μM or less.

In the case of the high strength cold rolled steel sheets in a 340 MPa-grade or more, it can be classified into steel wherein one or two of P, Si, and Cr, as solid solution-intensifying elements, are added to the ductile cold rolled steel sheet, and steel wherein N, as a precipitation-intensifying element, is increased in content in the ductile cold rolled steel sheets. That is, it is desirable that one or two of 0.2% or less of P, 0.1~0.8% of Si, and 0.2~1.2% of Cr be contained in the ductile cold rolled steel sheet. If P alone is added to in the ductile cold rolled steel sheet, 0.03~0.2% of P is preferably added to the ductile cold rolled steel sheet. Alternatively, high strength characteristics can be ensured by means of AlN precipitates by increasing the N content to 0.005~0.02%, and adding 0.03~0.06% of P.

In order to further enhance the formability of the cold rolled steel sheet, the steel sheet may further comprise 0.01~0.2% of Mo, and in order to ensure aging resistance, the steel sheet may further comprise 0.01~0.2% of V.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Preferred embodiments of the present invention will now be described in detail. However, it can be understood that the present invention is not limited to these embodiments.

The inventors of the present invention have found new facts, as will be described below, during investigations into enhancing the aging resistance of steel sheets without adding Ti and Nb. The fact is that fine precipitates of MnS, CuS, or (Mn, Cu)S can appropriately control the content of carbon in a solid solution state (that is, solid solution carbon) in a crystal grain, and contribute to enhanced aging resistance. These precipitates may have positive influences on an increase of the yield strength, enhancement of strength-ductility balance characteristics, and on an in-plane anisotropy index of the steel sheet due to precipitation strengthening.

As shown in FIG. 1, it can be seen that as the precipitates of MnS, CuS, and (Mn, Cu)S are distributed more finely, the content of the solid solution carbon in the crystal grain is deceased. Since the solid solution carbon remaining in the crystal grain is relatively free to move, carbon is moved and coupled to movable dislocations, influencing aging characteristics of the steel sheet. Accordingly, when the content of the solid solution carbon in the crystal grain is deceased below a predetermined level, the aging resistance can be enhanced. In view of ensuring the aging resistance, the content of the solid solution carbon in the crystal grain is maximally 20 ppm or less, and preferably 15 ppm or less.

Figure 1A:
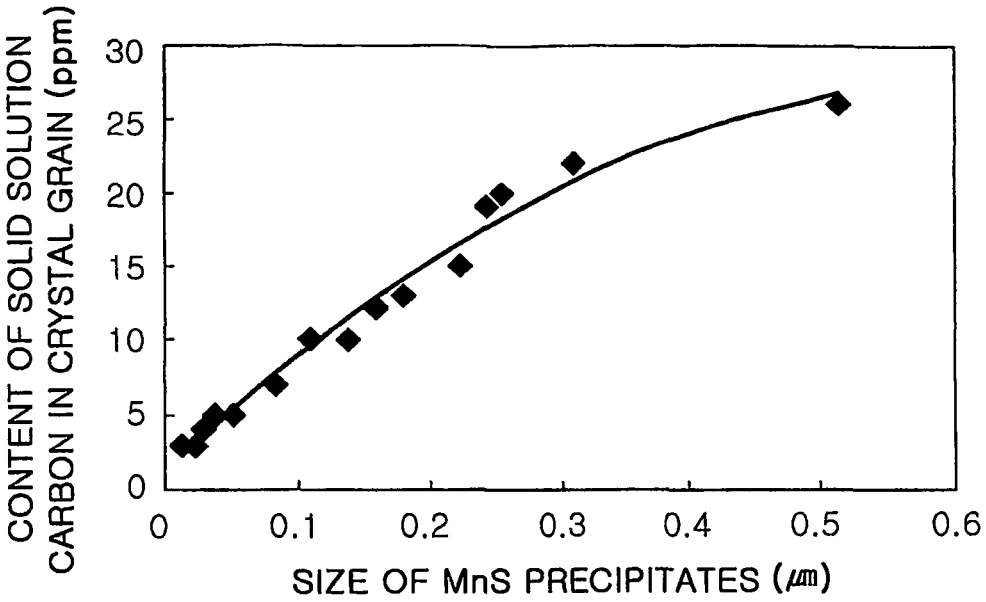
FIGS. 1*a* to 1*c* are graphical representations illustrating variations in carbon content in a solid solution state in a crystal grain according to a size of precipitates.
Figure 1B:
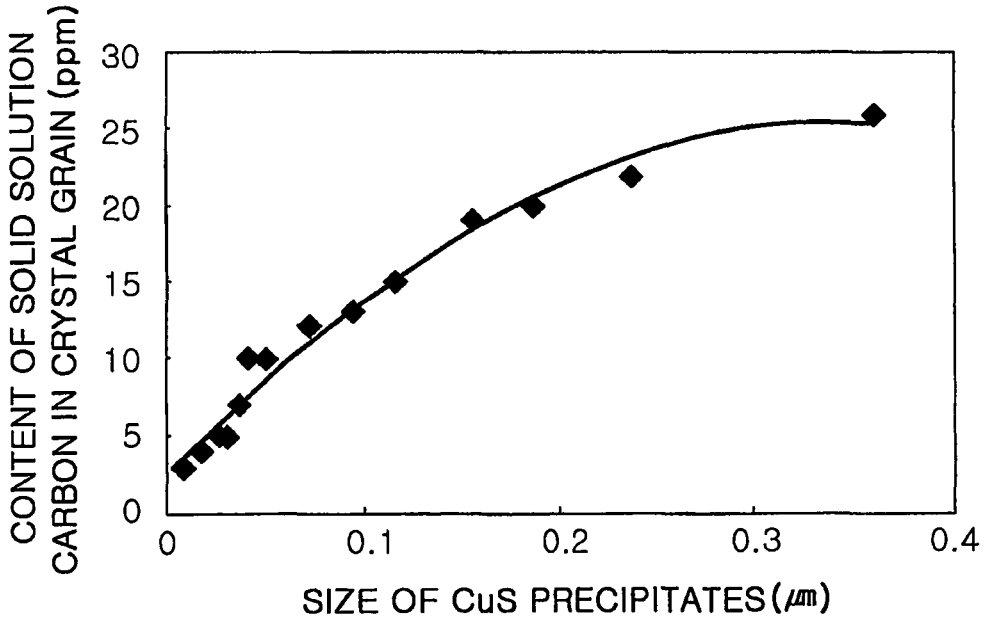
Figure 1C:
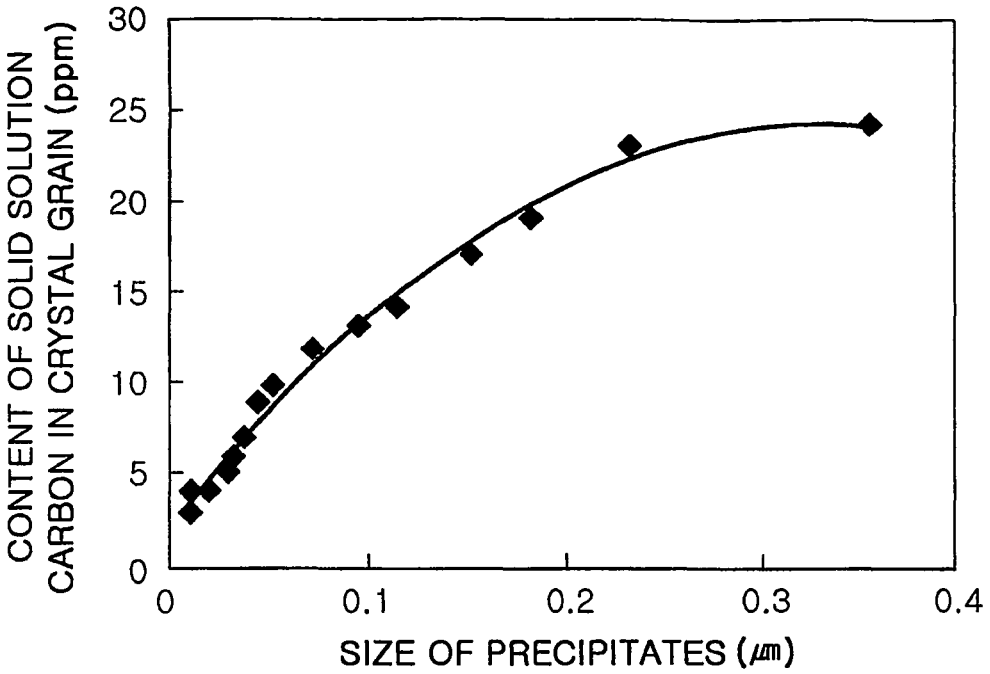

FIGS. 1*a* to 1*c* are graphical representations of steel comprising 0.003% of C, and it can be seen that when the precipitates of MnS, CuS, and (Mn, Cu)S are distributed in a size of 0.2 μm or less, the content of the solid solution carbon in the crystal grain is preferably controlled to be 20 ppm or less. With regard to the size of the precipitates for controlling the content of the solid solution carbon in the crystal grain to 15 ppm or less, which is the most appropriate condition, as can be seen from FIG. 1, the precipitates of MnS have a size of about 0.2 μm or less, the precipitates of CuS have a size of about 0.1 μm or less, and the precipitates of MnS, CuS, and (Mn, Cu)S have a size of about 0.1 μm or less.

As such, in order to control the content of the solid solution carbon in the crystal grain to be 20 ppm or less, it is important to finely distribute the precipitates of MnS, CuS and (Mn, Cu)S under the condition that 0.003 wt % or less carbon is contained in the steel. According to the present invention, with the fine precipitates of MnS, CuS, and (Mn, Cu)S, the carbon content is preferably increased to 0.003 wt %, which causes a low load in a steel manufacturing process.

Paying an attention to such new facts, there are investigations into a method of finely distributing the precipitates of MnS, CuS, and (Mn, Cu)S. The results indicate that what is needed is to control the contents of Mn, Cu, and S, and the composition of these elements in the steel, and that the fine particulates can be obtained by controlling cooling rates after hot rolling.

Figure 2A:
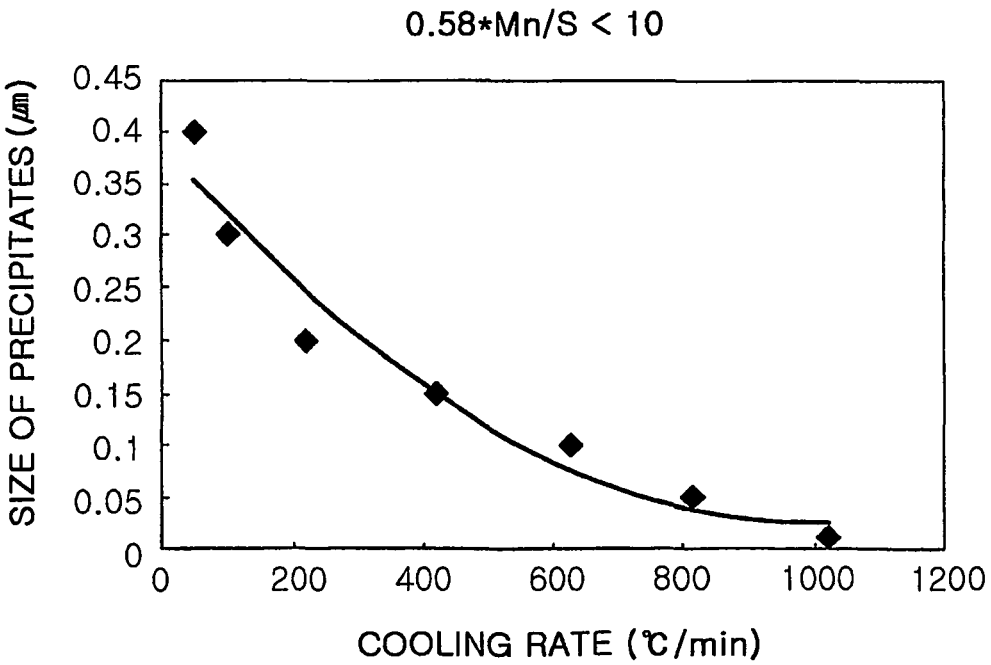
FIGS. 2*a* and 2*b* are graphical representations illustrating the size of MnS precipitates according to cooling rates.

FIG. 2*a* is a graphical representation obtained after investigating the size of precipitates according to a cooling rate after hot rolling a steel sheet comprising: 0.0018% of C; 0.15% of Mn; 0.008% of P; 0.015% of S; 0.03% of Al; and 0.0012% of N in terms of wt % (where 0.58*Mn/S=5.8). Referring to FIG. 2*a*, it can be found that, when appropriately controlling the cooling rate of the steel sheet under the condition wherein the combination of Mn and S satisfies the relationship: $0.58*Mn/S \leq 10$, the size of the MnS precipitates can be 0.2 μm or less.

Figure 3A:
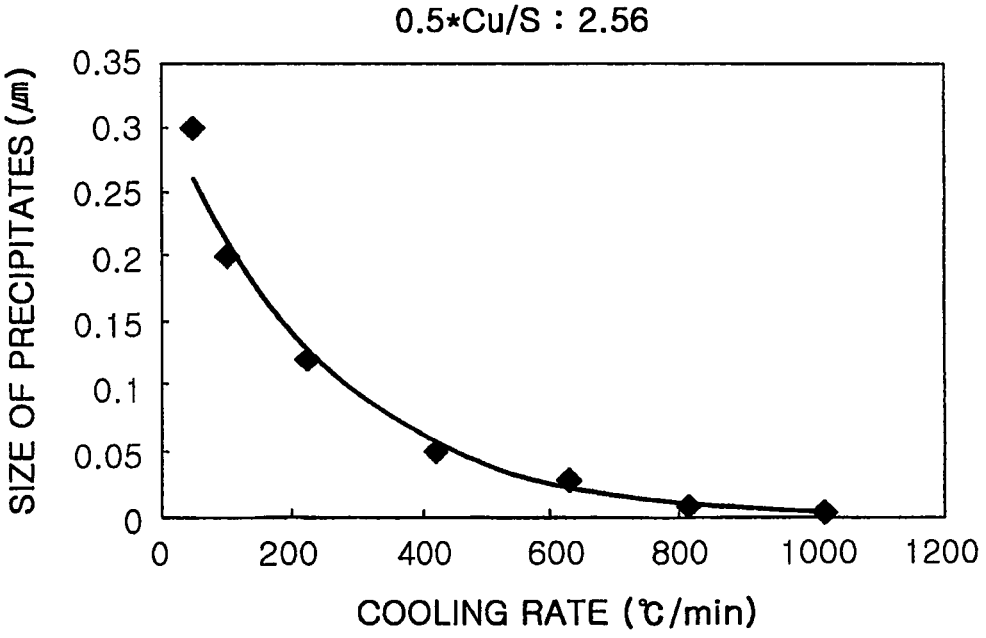
FIGS. 3*a* to 3*c* are graphical representations illustrating the size of CuS precipitates according to cooling rates.

FIG. 3*a* is a graphical representation obtained after investigating the size of precipitates according to a cooling rate after hot rolling a steel sheet comprising: 0.0018% of C; 0.01% of P; 0.008% of S; 0.05% of Al; 0.0014% of N; and 0.041% of Cu in terms of wt % (where 0.5*Cu/S=2.56). Referring to FIG. 3*a*, it can be found that when appropriately controlling the cooling rate for the steel sheet under the condition wherein the combination of Cu and S satisfies the relationship: $1 \leq 0.5*Cu/S \leq 10$, the size of the CuS precipitates can be 0.1 μm or less.

Figure 4A:
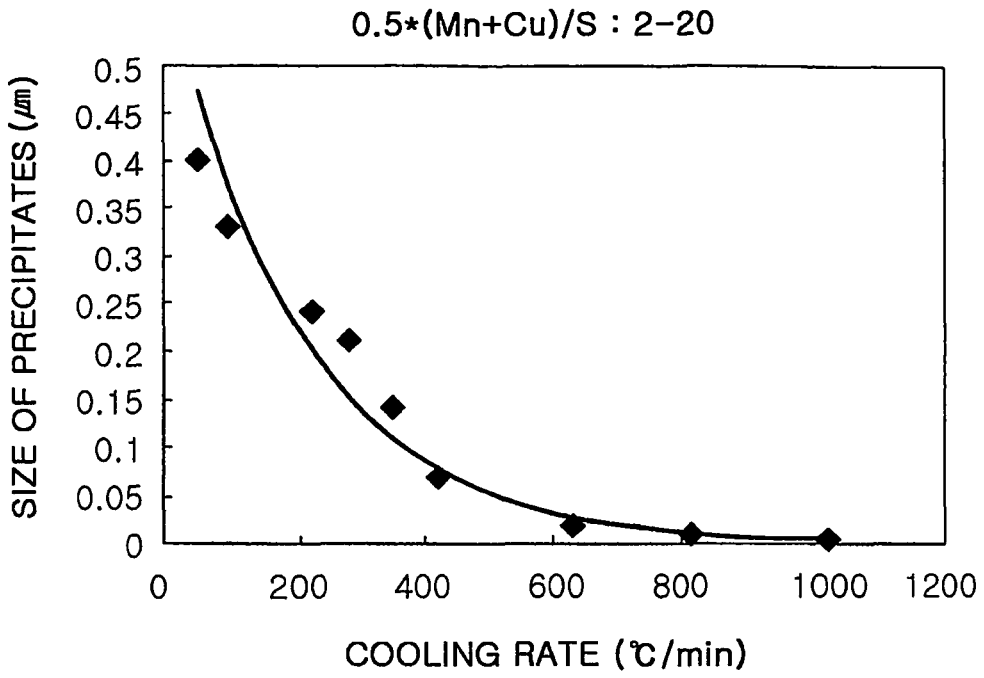
FIGS. 4*a* and 4*b* are graphical representations illustrating the size of MnS, CuS, and (Mn, Cu)S precipitates according to cooling rates.

FIG. 4*a* is a graphical representation obtained after investigating the size of precipitates according to a cooling rate after cold rolling steel sheet comprising: 0.0025% of C; 0.13% of Mn; 0.009% of P; 0.015% of S; 0.04% of Al; 0.0029% of N; and 0.04% of Cu in terms of wt % (where Mn+Cu=0.17 and 0.5*(Mn+Cu)/S=5.67). Referring to FIG. 4*a*, it can be found that when appropriately controlling the cooling rate for the steel sheet under the condition wherein the combination of Mn, Cu, and S satisfies the relationships: $Mn+Cu \leq 0.3$ and $2 \leq 0.5*(Mn+Cu)/S \leq 20$, the size of the MnS, CuS, (Mn, Cu)S precipitates can be 0.2 μm or less.

The cold rolled steel sheet of the invention has a high yield strength, and thus allows a reduction in thickness of the steel sheet, thereby providing an effect of weight reduction for the products thereof. Furthermore, due to low in-plane anisotropy, wrinkles and ears are rarely created when processing the steel sheet, and after processing the steel sheet, respectively. The cold rolled steel sheet of the present invention, and a method of manufacturing the same will be described in detail as follows.

Cold Rolled Steel Sheet of the Invention

Carbon (C): The carbon content is preferably 0.003 wt % or less.

If the carbon content is greater than 0.003 wt %, the amount of solid solution carbon is increased in a crystal grain, it is difficult to ensure the aging resistance of the steel, and the crystal grain in an annealed plate become reduced in size, thereby remarkably decreasing the ductility of the steel. More preferably, A carbon content is 0.0005~0.003 wt %. The carbon content less than 0.0005 wt % can lead to creation of coarse crystal grains in a hot rolled plate, thereby decreasing the strength of the steel while increasing the in-plane anisotropy thereof. According to the present invention, since the solid solution carbon in the steel can be reduced in amount, the carbon content can be increased to 0.003 wt %. Accordingly, a decarburizing treatment for ultimately reducing the carbon content can be omitted. For this purpose, the carbon content is preferably in the range of 0.002 wt %<C≤0.003 wt %.

Sulfur (S): The sulfur content is preferably 0.003~0.03 wt %.

A sulfur content less than 0.003 wt % can lead to not only decrease in the amount of MnS, CuS and (Mn, Cu), but also creation of excessively coarse precipitates, thereby lowering the aging resistance of the steel sheet. A sulfur content more than 0.03 wt % can lead to a large amount of solid solution sulfur, thereby remarkably decreasing the ductility and formability of the steel sheet, and increasing the possibility of hot shortness. According to the present invention, in the case of the MnS-precipitated steel, the sulfur content is preferably in the range of 0.005 wt %~0.03 wt %, and in the case of the CuS-precipitated steel, the sulfur content is preferably in the range of 0.003 wt % 0.025 wt %. In the case of the MnCu-precipitated steel, the sulfur content is preferably in the range of 0.003 wt %~0.025 wt %.

Aluminum (Al): The aluminum content is preferably 0.01~0.1 wt %.

Aluminum is an alloying element generally used as a deoxidizing agent. However, in the present invention, it is added to prevent the aging caused by solid solution nitrogen by precipitating nitrogen in the steel. An aluminum content less than 0.01 wt % can lead to a great amount of solid solution nitrogen, thereby making it difficult to prevent the aging, whereas an aluminum content more than 0.1 wt % can lead to a great amount of solid solution aluminum, thereby decreasing the ductility of the steel sheet. According to the present invention, in the case of the CuS-precipitated steel and the MnCu-precipitated steel, the aluminum content is preferably in the range of 0.01 wt %~0.08 wt %. If the nitrogen content is increased to 0.005~0.02%, a high strength steel sheet can be obtained by virtue of strengthening effects of AlN precipitates.

Nitrogen (N): The nitrogen content is preferably 0.02 wt % or less.

Nitrogen is an unavoidable element added into the steel during the steel manufacturing process, and in order to obtain the strengthening effects, it is preferably added into the steel to 0.02 wt %. In order to obtain the ductile steel sheet, the nitrogen content is preferably 0.004% or less. In order to obtain a high strength steel sheet, the nitrogen content is preferably 0.005~0.2%. Although the nitrogen content must be 0.005% or more in order to obtain the strengthening effects, a nitrogen content more than 0.02 wt % leads to deterioration in formability of the steel sheet. In order to provide a high strength steel using nitrogen, the phosphorous content is preferably 0.03~0.06%. According to the present invention, in order to ensure high strength by virtue of the AlN precipitates, the combination of Al and N, that is, 0.52*Al/N (where Al and N are denoted in terms of wt %) is preferably in the range of 1~5. The combination of Al and N (0.52*Al/N) less than 1 can lead to aging caused by solid solution nitrogen, and the combination of Al and N (0.52*Al/N) greater than 5 leads to negligible strengthening effects.

Phosphorus (P): The phosphorus content is preferably 0.2 wt % or less.

Phosphorus is an alloying element, which can increase solid solution strengthening effects while allowing a slight reduction in r-value (plasticity-anisotropy index), and can ensure the high strength of the steel in which the precipitates are controlled. Accordingly, in order to ensure the high strength by use of P, the P content is preferably 0.2 wt % or less. A phosphorus content more than 0.2 wt % can lead to a reduction in ductility of the steel sheet. When phosphorous alone is added to the steel in order to ensure the high strength of the steel sheet, the P content is preferably 0.03~0.2 wt %. For the ductile steel sheet, the P content is preferably 0.015 wt % or less. For the steel sheet ensuring high strength by use of the AlN precipitates, the P content is preferably 0.03~0.06 wt %. This is attributed to the fact that although a phosphorus content of 0.03 wt % or more enables a target strength to be ensured, a phosphorus content more than 0.06 wt % can lower the ductility and formability of the steel. According to the present invention, when the high strength of the steel sheet is ensured by means of addition of Si and Cr, the P content can be appropriately controlled to be 0.2 wt % or less in order to obtain the target strength.

According to the present invention, at least one of manganese (Mn) and copper (Cu) is preferably added to the steel. These elements are combined with sulfur (S), creating the MnS, CuS, (Mn, Cu)S precipitates.

Manganese (Mn): The manganese content is preferably 0.03~0.2 wt %.

Manganese is an alloying element, which precipitates the solid solution sulfur in the steel as the MnS precipitates, thereby preventing the hot shortness caused by the solid solution sulfur. In the present invention, Mn is precipitated as the fine MnS and/or (Mn, Cu)S precipitates under appropriate conditions for the combination of S and/or Cu with Mn and for the cooling rate, and plays an important role in enhancing the yield strength and the in-plane anisotropy of the steel sheet, while basically ensuring the aging resistance of the steel sheet. In order to realize these effects, the Mn content must be 0.03 wt % or more. Meanwhile, a Mn content greater than 0.2 wt % creates coarse precipitates, thereby deteriorating the aging resistance of the steel sheet. If Mn alone is added to the steel (that is, without adding Cu), the manganese content is preferably 0.05~0.2 wt %.

Copper (Cu): The copper content is preferably 0.005~0.2 wt %.

Copper is an alloying element, which creates fine precipitates under appropriate conditions of the combination of S and/or Mn with Cu, and the cooling rate before a coiling process during a hot rolling process, thereby reducing the amount of the solid solution carbon in the crystal grain, and plays an important role in enhancing aging resistance, in-plane anisotropy, and plasticity-anisotropy of the steel sheet. In order to create the fine precipitates, the Cu content must be 0.005 wt % or more. If the Cu content is more than 0.2 wt %, coarse precipitates are generated, thereby deteriorating the aging resistance of the steel sheet. If Cu alone is added to the steel (that is, without adding Mn), the Cu content is preferably 0.01~0.2 wt %.

According to the present invention, the contents and the combination of Mn, Cu and S are controlled so as to create fine precipitates, and these are varied according to the amount of Mn and Cu added.

In the case of MnS-precipitated steel, the combination of Mn and S preferably satisfies the relationship: 0.58*Mn/S≤10 (where Mn and S are denoted in terms of wt %). Mn combines with S to create the MnS precipitates, which can be varied in a precipitated state according to the amount of Mn and S added, and thereby influence the aging resistance, the yield strength, and the in-plane anisotropy index of the steel sheet. A value of 0.58*Mn/S greater than 10 creates coarse MnS precipitates, resulting in an increase of the aging index, thereby providing poor yield strength and in-plane anisotropy index.

In the case of CuS-precipitated steel, the combination of Cu and S preferably satisfies the relationship: 1≤0.5*Cu/S≤10 (where Cu and S are denoted in terms of wt %). Cu combines with S to create CuS precipitates, which are varied in a precipitated state according to the amount of Cu and S added, and thereby influence the aging resistance, the plasticity-anisotropy index, and the in-plane anisotropy index. A value of 0.5*Cu/S of 1 or more enables effective CuS precipitates to be created, and a value of 0.58*Mn/S greater than 10 creates coarse CuS precipitates, resulting in an increase of the aging index, and providing poor plasticity-anisotropy index and in-plane anisotropy index. In order to stably ensure the CuS precipitates of 0.1 μm or less, the value of 0.5*Cu/S is preferably 1~3.

When Mn is added to the steel sheet together with Cu, the total content of Mn and Cu is preferably 0.3 wt % or less. This is attributed to the fact that a content of Mn and Cu more than 0.3% is likely to create coarse precipitates, and thereby makes it difficult to ensure the aging resistance. Additionally, the value of 0.5*(Mn+Cu)/S (where Mn, Cu, and S are denoted in terms of wt %) is preferably 2~20. Mn and Cu combine with S to create the MnS, CuS, and (Mn, Cu)S precipitates, which are varied in a precipitated state according to the amount of Mn, Cu, and S added, and thereby influence the aging resistance, the plasticity-anisotropy index, and the in-plane anisotropy index. A value of 0.5*(Mn+Cu)/S of 2 or more enables effective precipitates to be created, and a value of 0.5*(Mn+Cu)/S greater than 20 creates coarse precipitates, resulting in an increase of the aging index, thereby providing poor plasticity-anisotropy index and in-plane anisotropy index. According to the present invention, with the value of 0.5*(Mn+Cu)/S in the range of 2~20, the average size of the precipitates is reduced to 0.2 μm or less.

In this case, it is desirable that the precipitates are distributed in the number of $2\times10^6$ precipitates/mm$^2$ or more. Starting from 7 as the value of 0.5*(Mn+Cu)/S, the sorts of precipitates and the number of the precipitates are remarkably varied. Specifically, when the value of 0.5*(Mn+Cu)/S is 7 or less, lots of very fine MnS and CuS separate precipitates are uniformly distributed rather that the (Mn, Cu)S complex precipitates. Meanwhile, when the value of 0.5*(Mn+Cu)/S is more than 7, regardless of a low difference between the sizes of the precipitates, the number of precipitates distributed in the crystal grain and grain boundary is decreased because of an increased amount of the (Mn, Cu)S complex precipitates. In the present invention, an increase in the number of the precipitates can enhance the aging resistance, the in-plane anisotropy index, and the secondary work embrittlement resistance. For this purpose, the precipitates are preferably distributed in the number of $2\times10^8$ or more. In the present invention, even in the case where the values of 0.5*(Mn+Cu)/S are the same, a smaller amount of Mn and Cu added can reduce the number of precipitates distributed in the crystal grain and grain boundary. If the content of Mn and Cu is increased, the precipitates become coarse, leading to a reduction in the number of precipitates distributed in the crystal grain and grain boundary.

According to the present invention, the MnS, CuS, and (Mn, Cu)S precipitates preferably have an average size of 0.2 μm or less. If the MnS, CuS, and (Mn, Cu)S precipitates have an average size greater than 0.2 μm, particularly, the aging index is rapidly increased, and the plasticity-anisotropy index, and the in-plane anisotropy index become poor. According to the present invention, a preferred size of the MnS is 0.2 μm or less, and a preferred size of the CuS is 0.1 μm or less. In the case where the MnS, CuS, and (Mn, Cu)S precipitates are mixed in the crystal grain, a size of the precipitates is preferably 0.2 μm or less, and more preferably, 0.1 μm or less. As the size of the precipitates is reduced, it is preferred in view of the aging resistance.

According to the present invention, when applied to the high strength steel sheet of the 340 MPa-grade or more, the solid solution strengthening elements, such as P, can be added to the steel sheet; that is, at least one of P, Si, and Cr can be added to the steel sheet. The effects obtained by adding phosphorus were previously described, and the description of this will be omitted.

Silicon (Si): The silicon content is preferably 0.1~0.8%.

Si is an alloying element, which can increase the solid solution strengthening effect while allowing a slight reduction in ductility, and thus ensure high strength of the steel in which the precipitates are controlled according to the present invention. A Si content of 0.1% or more can ensure the strength of the steel sheet, but a Si content more 0.8% can cause a reduction in the ductility thereof.

Chrome (Cr): The chrome content is preferably 0.2~1.2%.

Cr is an alloying element, which can increase solid solution strengthening effects while reducing a secondary work embrittlement temperature and the aging index by means of chrome carbides, and thus secures high strength while reducing the in-plane anisotropy index of the steel in which the precipitates are controlled according to the present invention. The Cr content of 0.2% or more can ensure the strength of the steel sheet, but the Cr content more 1.2% can cause the reduction in the ductility thereof.

According to the present invention, molybdenum (Mo) and/or vanadium (V) is preferably added to the cold rolled steel sheet.

Molybdenum (Mo): The molybdenum content is preferably 0.01~0.2%.

Mo is an alloying element, which can increase the plasticity-anisotropy index of the steel sheet. A Mo content of 0.01% or more can increase the plasticity-anisotropy index, but the Mo content greater than 0.2% can cause hot shortness without increasing the plasticity-anisotropy index any further.

Vanadium (V): The vanadium content is preferably 0.01~0.2%.

V is an alloying element, which can ensure aging resistance by precipitating solid solution C. A V content of 0.01% or more can increase the aging resistance, but the V content more than 0.2% can reduce the plasticity-anisotropy index. The composition of V and C (0.25*V/C) preferably satisfies the relationship: $1\leq0.25*V/C\leq20$ (where V and C are denoted in terms of wt %). A composition of V and C (0.25*V/C) less than 1 can reduce precipitation effect of the solid solution C, and a composition of V and C (0.25*V/C) more than 20 can lower the plasticity-anisotropy index.

Method of Manufacturing Cold Rolled Steel Sheet

The present invention is characterized in that steel sheets satisfying the above-described compositions are processed through hot rolling and cold rolling, thereby allowing an average size of precipitates on a cold rolled steel sheet to be reduced. The average size of the precipitates is influenced by the contents and composition of Mn, Cu, and S, and a manufacturing process, and in particular, is directly influenced by a cooling rate after hot rolling.

Hot Rolling Conditions

According to the present invention, the steel satisfying the above-described compositions is reheated, and is then subject to a hot rolling process. The reheating temperature is preferably 1,100° C. or more. When the steel is reheated to a temperature lower than 1,100° C., since coarse precipitates created during continuous casting remain in an incompletely dissolved state due to the low reheating temperature, the coarse precipitates continue to remain after hot rolling.

Preferably, the hot rolling is performed under the condition that finish rolling is performed at an $Ar_3$ transformation temperature or more. This is attributed to the fact that the finish rolling performed below the $Ar_3$ transformation temperature creates rolled grains, thereby remarkably lowering the ductility as well as the formability of the steel sheet.

The cooling rate is preferably 200° C./min or more after the hot rolling. More specifically, there is a slight difference between the cooling rates of (1) MnS-precipitated steel, (2) CuS-precipitated steel, and (3) MnCu-precipitated steel.

First, (1) in the case of the MnS-precipitated steel, the cooling rate is preferably 200° C./min or more. Even when the composition of Mn and S satisfies the relationship: 0.58*Mn/S≤10 according to the present invention, a cooling rate lower than 200° C./min can create coarse MnS precipitates having a size greater than 0.2 M. This is attributed to the fact that, as the cooling rate is increased, a number of nuclei are created, so that the MnS precipitates become fine. When the composition of Mn and S has the relationship: 0.58*Mn/S>10, the number of coarse precipitates in the incompletely dissolved state during the reheating process is increased, so that even if the cooling rate is increased, the number of nuclei is not increased, and thus the MnS precipitates do not become any finer (FIG. 2*b*, 0.024% of C; 0.43% of Mn; 0.011% of P; 0.009% of S; 0.035% of Al; and 0.0043% N in terms of wt %).

Figure 2B:
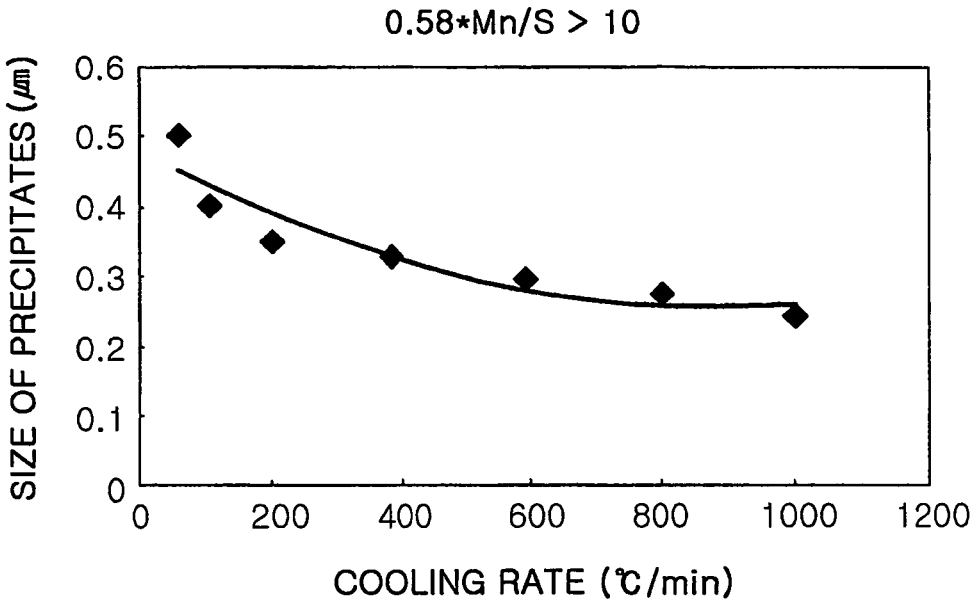

Referring to FIGS. 2*a* and 2*b*, since an increase of the cooling rate leads to creation of finer MnS precipitates, it is not necessary to provide an upper limit of the cooling rate. However, even when the cooling rate is 1,000° C./min or more, since the MnS precipitates are not further reduced in size, the cooling rate is more preferably 200~1,000° C./min.

Next, (2) in the case of the CuS-precipitated steel, the cooling rate is preferably 300° C./min or more after the hot rolling. Even when the composition of Cu and S satisfies the relationship: 0.5*Cu/S≤10 according to the present invention, a cooling rate lower than 300° C./min creates coarse CuS precipitates having a size greater than 0.1 μm. This is attributed to the fact that, as the cooling rate is increased, a number of nuclei are created, so that the CuS precipitates become fine. When the composition of Cu and S has the relationship: 0.5*Cu/S>10, the number of coarse precipitates in an incompletely dissolved state during the reheating process is increased, so that even if the cooling rate is increased, the number of nuclei are not increased, and thus the CuS precipitates do not become any finer (FIG. 3*c*, 0.0019% of C; 0.01% of P; 0.005% of S; 0.03% of Al; 0.0015% of N; and 0.28% Cu in terms of wt %).

Figure 3B:
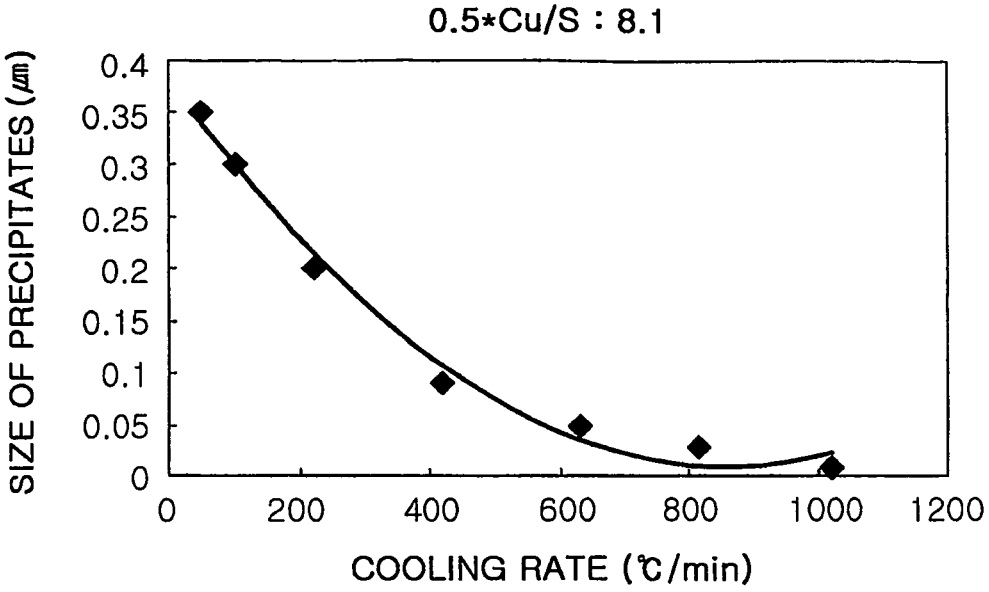
Figure 3C:
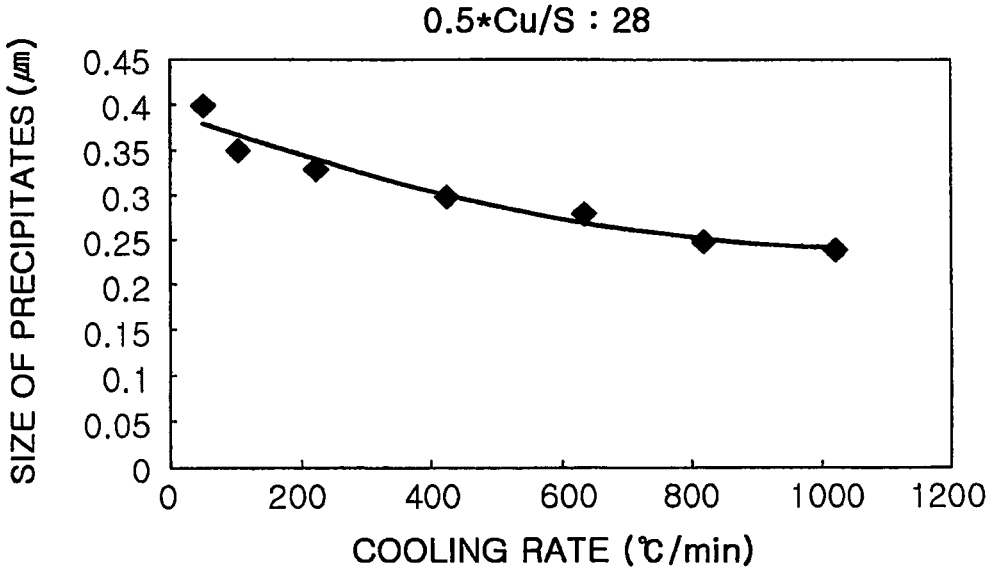

Referring to FIGS. 3*a* to 3*c*, since an increase of the cooling rate leads to creation of finer CuS precipitates, it is not necessary to provide an upper limit of the cooling rate. However, even when the cooling rate is 1,000° C./min or more, since the CuS precipitates are not further reduced in size the cooling rate is more preferably 300~1,000° C./min. FIGS. 3*a* and 3*b* (0.0018% of C; 0.01% of P; 0.005% of S; 0.03% of Al; and 0.0024% of N; and 0.081% Cu in terms of wt %) show the cases of 0.5*Cu/S≤3, and of 0.5*Cu/S>3, respectively. Referring to the drawings, it can be seen that when the value of 0.5*Cu/S is 3 or less, the CuS precipitates having a size of 0.1 μm or less can be more stably obtained.

Next, (3) in the case of the MnCu-precipitated steel, the cooling rate is preferably 300° C./min or more after the hot rolling. Even when the composition of Mn, Cu and S satisfies the relationship: 2≤0.5*(Mn+Cu)/S≤20 according to the present invention, a cooling rate lower than 300° C./min creates coarse precipitates having an average size greater than 0.2 μm.

This is attributed to the fact that, as the cooling rate is increased, a number of nuclei are created, so that the precipitates become fine. When the composition of Mn and S has the relationship: 0.5*(Mn+Cu)/S>20, the coarse precipitates in the incompletely dissolved state during the reheating process are increased, so that even if the cooling rate is increased, the number of nuclei is not increased, and thus the precipitates do not become any finer (FIG. 4*b*, 0.0025% of C; 0.4% of Mn; 0.01% of P; 0.01% of S; 0.05% of Al; 0.0016% of N; and 0.15% of Cu in terms of wt %).

Figure 4B:
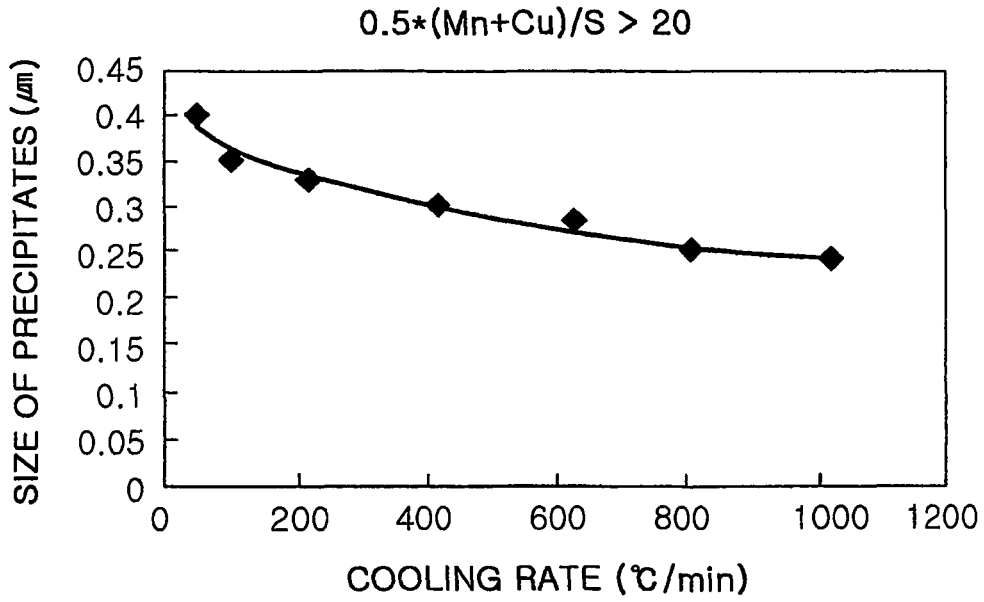

Referring to FIGS. 4*a* and 4*b*, since an increase of the cooling rate leads to creation of finer precipitates, it is not necessary to provide an upper limit of the cooling rate. However, even when the cooling rate is 1,000° C./min or more, since the precipitates are not further reduced in size, the cooling rate is more preferably 300~1,000° C./min or more.

Coiling Conditions

After the hot rolling process described above, the coiling process is preferably performed at a temperature of 700° C. or less. When the coiling process is performed at a temperature higher than 700° C., the precipitates are grown too coarsely, thereby reducing the aging resistance of the steel.

Cold Rolling Conditions

The steel is cold rolled to a desired thickness, preferably at a reduction rate of 50~90%. Since a reduction rate less than 50% leads to creation of a small amount of nuclei upon recrystallization annealing, the crystal grains are grown excessively upon annealing, so that coarse grains recrystallized through annealing are created, thereby reducing the strength and formability of the steel sheet. A cold reduction rate more than 90% leads to enhanced formability, while creating an excessive number of nuclei, so that the grains recrystallized through annealing become excessively finer, thereby reducing the ductility of the steel.

Continuous Annealing

Continuous annealing temperature plays an important role in determining the mechanical properties of the products. According to the present invention, the continuous annealing is preferably performed at a temperature of 500~900° C. Continuous annealing at a temperature lower than 500° C. creates excessively fine recrystallized crystal grains, so that a desired ductility cannot be obtained. Continuous annealing at a temperature higher than 900° C. creates coarse recrystallized crystal grains, so that the strength of the steel is reduced. Holding time at the continuous annealing is maintained so as to complete the recrystallization of the steel, and the recrystallization of the steel can be completed within about 10 seconds or more upon continuous annealing.

The present invention will be described in detail with reference to examples as follows.

In the following description of the examples, the steel sheet was machined to standard samples according to ASTM standards (ASTM E-8 standard), and the mechanical properties thereof were measured. The yield strength, the tensile strength, the elongation, the plasticity-anisotropy index (r-value), the in-plane anisotropy index (Δr value), and the aging index (AI) were measured by use of a tensile strength tester (available from INSTRON Company, Model 6025). In the examples, the plasticity-anisotropy index (r-value) and the in-plane anisotropy index (Δr value) were obtained by means of the following equations: r-value($r_m=(r_0+2r_{45}+r_{90})/4$ and $\Delta r=(r_0-2\ r_{45}+r_{90})/2$).

Additionally, in order to obtain an average size and the number of the precipitates distributed in the samples, the size and the number of all precipitates existing in the material were measured.

Example 1-1

MnS-Precipitated Steel

In order to achieve MnS-precipitated steel according to the present invention, after steel slabs shown in Table 1 were reheated to a temperature of 1,200° C. followed by finish rolling the steel slabs to provide hot rolled steel sheets, the hot rolled steel sheets were cooled at a speed of 200° C./min, and coiled at 650° C.

Then, the hot rolled steel sheets were subjected to cold rolling at a reduction rate of 75% followed by continuous annealing. The finish rolling was performed at 910° C., which is above the $Ar_3$ transformation temperature, and the continuous annealing was performed by means of heating the steel sheets to 750° C. at a speed of 10° C./second for 40 seconds. Exceptionally, the sample A8 in Table 1, after being reheated to a temperature of 1,050° C., and then subjected to finish rolling, the sample was cooled at a speed of 50° C./minute, and was then wound at 750° C.

TABLE 1

| | Component (wt %) | | | | | | | | | |
|---|---|---|---|---|---|---|---|---|---|---|
| Sample No. | C ≤0.003 | Mn 0.05-0.2 | P ≤0.015 | S 0.005-0.03 | Al 0.01-0.1 | N ≤0.004 | Mo 0.01-0.2 | V 0.01-0.2 | R-1 ≤10 | R-2 1-20 |
| A1 | 0.0023 | 0.08 | 0.01 | 0.005 | 0.04 | 0.0015 | — | — | 9.28 | |
| A2 | 0.0018 | 0.10 | 0.011 | 0.012 | 0.05 | 0.0026 | — | — | 4.83 | |
| A3 | 0.0018 | 0.15 | 0.008 | 0.015 | 0.03 | 0.0012 | — | — | 5.8 | |
| A4 | 0.0027 | 0.09 | 0.012 | 0.025 | 0.035 | 0.0018 | — | — | 2.09 | |
| A5 | 0.0026 | 0.4 | 0.009 | 0.01 | 0.02 | 0.0039 | — | — | 23.2 | |
| A6 | 0.0038 | 0.10 | 0.011 | 0.008 | 0.05 | 0.0038 | — | — | 7.25 | |
| A7 | 0.0015 | 0.35 | 0.01 | 0.032 | 0.03 | 0.0015 | — | — | 6.34 | |
| A8 | 0.0023 | 0.08 | 0.01 | 0.008 | 0.04 | 0.0015 | — | — | 5.8 | |
| A9 | 0.0013 | 0.09 | 0.01 | 0.008 | 0.033 | 0.025 | 0.03 | — | 6.53 | |
| A10 | 0.0022 | 0.15 | 0.012 | 0.011 | 0.025 | 0.0022 | 0.053 | — | 7.91 | |
| A11 | 0.0015 | 0.10 | 0.008 | 0.015 | 0.043 | 0.0023 | 0.074 | — | 3.87 | |
| A12 | 0.0025 | 0.1 | 0.009 | 0.021 | 0.034 | 0.0028 | 0.11 | — | 2.76 | |
| A13 | 0.0022 | 0.12 | 0.009 | 0.014 | 0.03 | 0.0021 | 0.15 | — | 4.97 | |
| A14 | 0.0022 | 0.4 | 0.009 | 0.009 | 0.032 | 0.0033 | 0.25 | — | 25.8 | |
| A15 | 0.0015 | 0.1 | 0.011 | 0.009 | 0.033 | 0.0025 | — | 0.023 | 6.44 | 3.83 |
| A16 | 0.0024 | 0.08 | 0.01 | 0.01 | 0.035 | 0.0012 | — | 0.051 | 4.64 | 5.13 |
| A17 | 0.0025 | 0.12 | 0.008 | 0.012 | 0.023 | 0.0015 | — | 0.08 | 5.8 | 8 |
| A18 | 0.0015 | 0.11 | 0.01 | 0.02 | 0.032 | 0.002 | — | 0.11 | 3.19 | 18.3 |
| A19 | 0.0027 | 0.08 | 0.008 | 0.01 | 0.033 | 0.0011 | — | 0.154 | 4.64 | 14.3 |
| A20 | 0.002 | 0.4 | 0.01 | 0.013 | 0.022 | 0.0013 | — | 0.325 | 17.8 | 30 |
| A21 | 0.0023 | 0.11 | 0.011 | 0.011 | 0.023 | 0.0017 | 0.017 | 0.025 | 5.8 | 2.72 |
| A22 | 0.0027 | 0.09 | 0.01 | 0.009 | 0.037 | 0.0027 | 0.074 | 0.082 | 5.8 | 7.59 |
| A23 | 0.0025 | 0.08 | 0.009 | 0.012 | 0.032 | 0.0031 | 0.15 | 0.16 | 3.87 | 16 |

Note:

R-1 = 0.58 * Mn/S,

R-2 = 0.25 * V/C

TABLE 2

| | Mechanical properties | | | | | | | |
|---|---|---|---|---|---|---|---|---|
| Sample No. | YP (Mpa) | TS (MPa) | El (%) | r-value ($r_m$) | Δr-value (Δr) | AI (MPa) | AS (μm) | Remarks |
| A1 | 211 | 309 | 49 | 1.83 | 0.28 | 23 | 0.05 | IS |
| A2 | 209 | 311 | 52 | 1.93 | 0.34 | 22 | 0.12 | IS |
| A3 | 201 | 295 | 54 | 1.94 | 0.31 | 21 | 0.15 | IS |
| A4 | 223 | 319 | 48 | 1.88 | 0.23 | 27 | 0.14 | IS |
| A5 | 211 | 312 | 48 | 1.93 | 0.52 | 34 | 0.62 | CS |
| A6 | 254 | 329 | 45 | 1.57 | 0.41 | 49 | 0.09 | CS |
| A7 | 222 | 316 | 48 | 1.82 | 0.58 | 38 | 0.46 | CS |
| A8 | 200 | 291 | 53 | 1.69 | 0.48 | 37 | 0.34 | CS |
| A9 | 213 | 311 | 50 | 2.24 | 0.31 | 15 | 0.06 | IS |
| A10 | 209 | 307 | 53 | 2.15 | 0.25 | 25 | 0.11 | IS |
| A11 | 219 | 318 | 49 | 2.34 | 0.28 | 16 | 0.12 | IS |
| A12 | 220 | 321 | 49 | 2.25 | 0.24 | 26 | 0.13 | IS |
| A13 | 234 | 328 | 49 | 2.20 | 0.31 | 24 | 0.14 | IS |
| A14 | 241 | 333 | 47 | 2.01 | 0.43 | 42 | 0.54 | CS |
| A15 | 175 | 295 | 50 | 1.82 | 0.26 | 0 | 0.06 | IS |
| A16 | 163 | 301 | 53 | 1.86 | 0.21 | 0 | 0.11 | IS |
| A17 | 158 | 284 | 49 | 1.9 | 0.19 | 0 | 0.12 | IS |
| A18 | 148 | 278 | 49 | 1.77 | 0.17 | 0 | 0.13 | IS |
| A19 | 175 | 302 | 49 | 1.74 | 0.18 | 0 | 0.14 | IS |

TABLE 2-continued

| Sample No. | Mechanical properties YP (Mpa) | TS (MPa) | El (%) | r-value ($r_m$) | Δr-value (Δr) | AI (MPa) | AS (μm) | Remarks |
|---|---|---|---|---|---|---|---|---|
| A20 | 182 | 308 | 47 | 1.52 | 0.21 | 0 | 0.54 | CS |
| A21 | 158 | 290 | 50 | 2.19 | 0.35 | 0 | 0.07 | IS |
| A22 | 162 | 288 | 49 | 2.22 | 0.39 | 0 | 0.08 | IS |
| A23 | 172 | 292 | 49 | 2.08 | 0.29 | 0 | 0.11 | IS |

Note:
YP = Yield strength,
TS = Tensile strength,
El = Elongation,
r-value: Plasticity-anisotropy index,
Δr-value: In-plane anisotropy index,
AI = Aging Index,
AS = Average size of precipitates,
IS = Steel of the invention,
CS = Comparative steel As shown in Table 2, steel of the invention has not only high aging resistance, but also high yield strength and excellent formability.

Meanwhile, the sample A5 has 0.58*Mn/S of 23.2, coarse precipitates in an average size of 0.62 μm, and an aging index of 34 MPa, which results in poor aging resistance. The sample A6 has a high content of carbon, and thus has an aging index of 49 MPa, which is excessively high, and also results in poor aging resistance. The sample A7 has 0.58*Mn/S of 6.34, which is within the range of the present invention. However, it has a content of Mn and S deviated from the range of the present invention, and creates coarse MnS precipitates, thereby providing an aging index of 38 MPa. Accordingly, in the sample A7, the aging resistance cannot be secured, and the formability of the steel sheet is poor. Exceptionally, in the case of the sample A8, since the recrystallization temperature is 1,050° C., which is excessively low, the precipitates cannot be incompletely dissolved during reheating, creating excessive precipitates, which are incompletely dissolved, and due to an excessively high coiling temperature, the precipitates are coarse in an average size of 0.34 μm, so that it is difficult to secure the aging resistance.

Example 1-2

High Strength CuS-Precipitated Steel with Solid Solution Strengthening

In order to achieve the high strength CuS-precipitated steel according to the present invention, after steel slabs shown in Table 3 were reheated to a temperature of 1,200° C., followed by finish rolling the steel slabs to provide hot rolled steel sheets, the steel sheets were cooled at a speed of 200° C./min, and coiled at 650° C. Then, the hot rolled steel sheets were sequentially subjected to cold rolling at a reduction rate of 75% followed by continuous annealing. The finish rolling was performed at 910° C., which is above the $Ar_3$ transformation temperature, and the continuous annealing was performed by means of heating the steel sheets to 750° C. at a speed of 10° C./second for 40 seconds.

TABLE 3

| Sample No. | Component (wt %) C ≤0.003 | Mn 0.05-0.2 | P ≤0.2 | Si 0.1-0.8 | Cr 0.2-1.2 | S 0.005-0.03 | Al 0.01-0.1 | N ≤0.004 | Mo 0.01-0.2 | V 0.01-0.2 | R-1 ≤10 | R-2 1-20 |
|---|---|---|---|---|---|---|---|---|---|---|---|---|
| B1 | 0.0023 | 0.08 | 0.052 | — | — | 0.006 | 0.04 | 0.0015 | — | — | 7.73 | |
| B2 | 0.0018 | 0.10 | 0.102 | — | — | 0.010 | 0.05 | 0.0026 | — | — | 5.8 | |
| B3 | 0.0025 | 0.08 | 0.151 | — | — | 0.012 | 0.035 | 0.0018 | — | — | 3.87 | |
| B4 | 0.0022 | 0.4 | 0.109 | — | — | 0.011 | 0.05 | 0.0038 | — | — | 21.1 | |
| B5 | 0.0024 | 0.4 | 0.07 | — | — | 0.01 | 0.04 | 0.0016 | Ti: 0.05 | — | | |
| B6 | 0.0019 | 0.11 | 0.01 | 0.22 | — | 0.008 | 0.04 | 0.0012 | — | — | 7.78 | |
| B7 | 0.0018 | 0.1 | 0.011 | 0.62 | — | 0.009 | 0.035 | 0.0025 | — | — | 6.4 | |
| B8 | 0.0026 | 0.42 | 0.01 | 0.25 | — | 0.01 | 0.03 | 0.0028 | — | — | 24.4 | |
| B9 | 0.0024 | 0.09 | 0.01 | — | 0.32 | 0.007 | 0.05 | 0.0012 | — | — | 7.46 | |
| B10 | 0.0022 | 0.11 | 0.015 | — | 0.63 | 0.012 | 0.04 | 0.0028 | — | — | 5.31 | |
| B11 | 0.0018 | 0.11 | 0.011 | — | 0.95 | 0.015 | 0.03 | 0.0022 | — | — | 4.25 | |
| B12 | 0.0017 | 0.1 | 0.048 | — | — | 0.01 | 0.034 | 0.0025 | 0.025 | — | 5.8 | |
| B13 | 0.002 | 0.09 | 0.011 | 0.21 | — | 0.01 | 0.024 | 0.0018 | 0.02 | — | 5.22 | |
| B14 | 0.0014 | 0.1 | 0.011 | — | 0.3 | 0.008 | 0.03 | 0.0032 | 0.025 | — | 7.25 | |
| B15 | 0.002 | 0.09 | 0.048 | 0.21 | 0.3 | 0.012 | 0.033 | 0.0022 | 0.1 | — | 4.35 | |
| B16 | 0.0018 | 0.11 | 0.05 | — | — | 0.011 | 0.03 | 0.002 | — | 0.02 | 5.8 | 2.78 |
| B17 | 0.0022 | 0.11 | 0.01 | 0.25 | — | 0.009 | 0.034 | 0.0022 | — | 0.021 | 7.08 | 2.39 |
| B18 | 0.0015 | 0.11 | 0.01 | — | 0.33 | 0.01 | 0.023 | 0.0022 | — | 0.02 | 6.38 | 3.33 |
| B19 | 0.0023 | 0.09 | 0.054 | — | — | 0.01 | 0.043 | 0.0029 | 0.021 | 0.017 | 5.22 | 1.85 |
| B20 | 0.0026 | 0.09 | 0.012 | 0.26 | — | 0.011 | 0.024 | 0.0019 | 0.019 | 0.016 | 4.75 | 1.54 |
| B21 | 0.0025 | 0.11 | 0.01 | — | 0.33 | 0.01 | 0.023 | 0.0022 | 0.017 | 0.021 | 6.38 | 2.1 |

Note:
R-1 = 0.58 * Mn/S,
R-2 = 0.25 * V/C

TABLE 4

| Sample No. | Mechanical properties YP (MPa) | TS (MPa) | El (%) | r-value ($r_m$) | Δr-value (Δr) | AI (MPa) | DBTT (° C.) | AS (μm) | Remarks |
|---|---|---|---|---|---|---|---|---|---|
| B1 | 241 | 356 | 47 | 1.83 | 0.31 | 28 | −70 | 0.11 | IS |
| B2 | 299 | 402 | 42 | 1.65 | 0.32 | 23 | −50 | 0.09 | IS |
| B3 | 352 | 456 | 35 | 1.53 | 0.31 | 27 | −40 | 0.14 | IS |
| B4 | 289 | 394 | 39 | 1.63 | 0.58 | 45 | −60 | 0.73 | CS |
| B5 | 210 | 353 | 40 | 1.73 | 0.58 | 0 | +0 | — | CVS |
| B6 | 241 | 356 | 50 | 1.75 | 0.28 | 24 | −80 | 0.11 | IS |
| B7 | 352 | 456 | 38 | 1.47 | 0.31 | 22 | −50 | 0.14 | IS |
| B8 | 231 | 346 | 45 | 1.72 | 0.58 | 42 | −70 | 0.49 | CS |
| B9 | 235 | 352 | 47 | 1.70 | 0.20 | 21 | −80 | 0.08 | IS |
| B10 | 299 | 418 | 44 | 1.51 | 0.19 | 18 | −60 | 0.07 | IS |
| B11 | 349 | 459 | 36 | 1.42 | 0.23 | 16 | −50 | 0.11 | IS |
| B12 | 238 | 359 | 46 | 2.09 | 0.3 | 18 | −80 | 0.13 | IS |
| B13 | 238 | 362 | 48 | 2.09 | 0.32 | 22 | −80 | 0.11 | IS |
| B14 | 228 | 358 | 48 | 2.17 | 0.25 | 15 | −80 | 0.1 | IS |
| B15 | 350 | 470 | 35 | 1.61 | 0.15 | 19 | −60 | 0.1 | IS |
| B16 | 203 | 355 | 44 | 1.76 | 0.23 | 0 | −70 | 0.12 | IS |
| B17 | 198 | 360 | 47 | 1.77 | 0.32 | 0 | −70 | 0.13 | IS |
| B18 | 197 | 352 | 47 | 1.65 | 0.28 | 0 | −80 | 0.11 | IS |
| B19 | 205 | 356 | 44 | 2.01 | 0.31 | 0 | −60 | 0.11 | IS |
| B20 | 198 | 360 | 47 | 1.77 | 0.27 | 0 | −70 | 0.13 | IS |
| B21 | 201 | 350 | 48 | 1.98 | 0.28 | 0 | −70 | 0.07 | IS |

Note:
YP = Yield strength,
TS = Tensile strength,
El = Elongation,
r-value: Plasticity-anisotropy index,
Δr-value: In-plane anisotropy index,
AI = Aging Index,
DBTT = ductility-brittleness transition temperature for investigating secondary work embrittlement,
AS = Average size of precipitates,
IS = Steel of the invention,
CS = Comparative steel,
CVS = Conventional steel As shown in Table 3, the samples B1~B3, and B6 and B7 have a yield strength of 240 MPa or more, an elongation of 35% or more, and yield strength-ductility balance (yield strength*ductility) of 11,3000. Steels of the invention have excellent formability, and an aging index of 30 MPa or less, so that the aging resistance can be secured. Additionally, steels of the invention have a ductility-brittleness transition temperature of −40° C. or less, and are excellent in a secondary work embrittlement.

The sample B5 (conventional steel) is high strength cold rolled steel sheet, and has an excellent aging index. However, due to a high ductility-brittleness transition temperature, there is a high possibility of fracture, even at the room temperature upon impact.

Example 1-3

MnS-Precipitated Steel with AlN Precipitation Strengthening

After steel slabs shown in Table 5 were reheated to a temperature of 1,200° C. followed by finish rolling the steel slabs to provide hot rolled steel sheets, the steel sheets were cooled at a speed of 200° C./min, and coiled at 650° C. Then, the hot rolled steel sheets were sequentially subjected to cold rolling at a reduction rate of 75% followed by continuous annealing. The finish rolling was performed at 910° C., which is above the $Ar_3$ transformation temperature, and the continuous annealing was performed by means of heating the steel sheets to 750° C. at a speed of 10° C./second for 40 seconds.

TABLE 5

| Sample No. | Component (wt %) C ≤0.003 | Mn 0.05-0.2 | P 0.03-0.06 | S 0.005-0.03 | Al 0.01-0.1 | N 0.005-0.02 | Mo 0.01-0.2 | V 0.01-0.2 | R-1 ≤10 | R-3 1-5 | R-2 1-20 |
|---|---|---|---|---|---|---|---|---|---|---|---|
| C1 | 0.0019 | 0.1 | 0.04 | 0.008 | 0.042 | 0.015 | | | 6.5 | 1.46 | |
| C2 | 0.0028 | 0.09 | 0.042 | 0.007 | 0.04 | 0.0068 | | | 7.73 | 3.06 | |
| C3 | 0.0023 | 0.11 | 0.04 | 0.010 | 0.05 | 0.0082 | | | 5.8 | 3.17 | |
| C4 | 0.0018 | 0.08 | 0.043 | 0.009 | 0.055 | 0.0065 | | | 3.87 | 4.4 | |
| C5 | 0.0022 | 0.09 | 0.04 | 0.011 | 0.008 | 0.0067 | | | 6.53 | 0.46 | |
| C6 | 0.0019 | 0.4 | 0.04 | 0.009 | 0.04 | 0.0083 | | | 25.8 | 2.51 | |
| C7 | 0.0015 | 0.11 | 0.042 | 0.01 | 0.055 | 0.012 | 0.028 | | 6.38 | 2.25 | |

TABLE 5-continued

| Sample No. | Component (wt %) C ≤0.003 | Mn 0.05-0.2 | P 0.03-0.06 | S 0.005-0.03 | Al 0.01-0.1 | N 0.005-0.02 | Mo 0.01-0.2 | V 0.01-0.2 | R-1 ≤10 | R-3 1-5 | R-2 1-20 |
|---|---|---|---|---|---|---|---|---|---|---|---|
| C8 | 0.0012 | 0.1 | 0.04 | 0.008 | 0.033 | 0.011 | | 0.018 | 7.25 | 1.56 | 3.75 |
| C9 | 0.0023 | 0.11 | 0.043 | 0.008 | 0.053 | 0.011 | 0.022 | 0.017 | 7.98 | 2.51 | 1.85 |

Note:
R-1 = 0.58 * Mn/S,
R-2 = 0.25 * V/C,
R-3 = 0.52 * Al/N

TABLE 6

| Sample No. | Mechanical properties YP (MPa) | TS (MPa) | El (%) | r-value ($r_m$) | Δr-value (Δr) | AI (MPa) | DBTT (° C.) | AS (μm) | Remarks |
|---|---|---|---|---|---|---|---|---|---|
| C1 | 231 | 352 | 46 | 1.78 | 0.31 | 22 | −70 | 0.07 | IS |
| C2 | 229 | 344 | 48 | 1.82 | 0.38 | 25 | −70 | 0.09 | IS |
| C3 | 235 | 348 | 48 | 1.83 | 0.31 | 22 | −70 | 0.09 | IS |
| C4 | 231 | 346 | 48 | 1.82 | 0.32 | 25 | −70 | 0.07 | IS |
| CS | 218 | 332 | 42 | 1.62 | 0.34 | 49 | −70 | 0.12 | CS |
| C6 | 221 | 328 | 46 | 1.72 | 0.54 | 38 | −70 | 0.38 | CS |
| C7 | 225 | 355 | 47 | 2.15 | 0.31 | 12 | −80 | 0.08 | IS |
| CS | 195 | 354 | 47 | 1.76 | 0.29 | 0 | −70 | 0.09 | IS |
| C9 | 198 | 350 | 48 | 1.99 | 0.29 | 0 | −70 | 0.1 | IS |

Note:
YP = Yield strength,
TS = Tensile strength,
El = Elongation,
r-value: Plasticity-anisotropy index,
Δr-value: In-plane anisotropy index,
AI = Aging Index,
DBTT = ductility-brittleness transition temperature for investigating secondary work embrittlement,
AS = Average size of precipitates,
IS = Steel of the invention,
CS = Comparative steel

Example 2-1

CuS-Precipitated Steel

After steel slabs shown in Table 7 were reheated to a temperature of 1,200° C. followed by finish rolling the steel slabs to provide hot rolled steel sheets, the hot rolled steel sheets were cooled at a speed of 400° C./min, and coiled at 650° C. Then, the hot rolled steel sheets were subjected to cold rolling at a reduction rate of 75% followed by continuous annealing. The finish rolling was performed at 910° C., which is above the $Ar_3$ transformation temperature, and the continuous annealing was performed by means of heating the steel sheets to 750° C. at a speed of 10° C./second for 40 seconds. Exceptionally, in the case of the sample D8 in Table 7, after being reheated to a temperature of 1,050° C., and then subjected to finish rolling, the sample was cooled at a speed of 400° C./minute, and was then wound at 650° C. Further, in the case of the samples D14 D17, after being reheated to a temperature of 1,250° C., and then subjected to finish rolling, the samples were cooled at a speed of C/minute, and were then wound at 650° C.

TABLE 7

| Sample No. | Component (wt %) C ≤0.003 | P ≤0.015 | S 0.003-0.025 | Al 0.01-0.1 | N ≤0.004 | Cu 0.01-0.2 | Mo 0.01-0.2 | V 0.01-0.2 | R-4 1-10 | R-2 1-20 |
|---|---|---|---|---|---|---|---|---|---|---|
| D1 | 0.0017 | 0.007 | 0.008 | 0.04 | 0.0028 | 0.035 | | | 2.19 | |
| D2 | 0.0018 | 0.010 | 0.008 | 0.05 | 0.0014 | 0.041 | | | 2.56 | |
| D3 | 0.0016 | 0.012 | 0.015 | 0.03 | 0.0012 | 0.083 | | | 2.77 | |
| D4 | 0.0025 | 0.009 | 0.005 | 0.02 | 0.0039 | 0.021 | | | 2.1 | |
| D5 | 0.0018 | 0.01 | 0.005 | 0.03 | 0.0024 | 0.081 | | | 8.1 | |
| D6 | 0.0022 | 0.011 | 0.012 | 0.05 | 0.0038 | 0.005 | | | 0.21 | |
| D7 | 0.0019 | 0.01 | 0.005 | 0.03 | 0.0015 | 0.28 | | | 28 | |
| D8 | 0.0018 | 0.010 | 0.008 | 0.05 | 0.0014 | 0.041 | | | 2.56 | |
| D9 | 0.0015 | 0.01 | 0.01 | 0.035 | 0.0022 | 0.038 | 0.015 | | 1.9 | |
| D10 | 0.0028 | 0.011 | 0.008 | 0.025 | 0.0021 | 0.045 | 0.05 | | 2.81 | |
| D11 | 0.0018 | 0.009 | 0.012 | 0.033 | 0.0032 | 0.084 | 0.11 | | 3.5 | |
| D12 | 0.0024 | 0.01 | 0.009 | 0.042 | 0.0029 | 0.031 | 0.17 | | 1.72 | |
| D13 | 0.0028 | 0.011 | 0.012 | 0.035 | 0.0024 | 0.035 | 0.28 | | 1.46 | |
| D14 | 0.0018 | 0.009 | 0.011 | 0.025 | 0.0026 | 0.03 | | 0.025 | 1.36 | 3.47 |

TABLE 7-continued

| Sample No. | Component (wt %) C ≤0.003 | P ≤0.015 | S 0.003-0.025 | Al 0.01-0.1 | N ≤0.004 | Cu 0.01-0.2 | Mo 0.01-0.2 | V 0.01-0.2 | R-4 1-10 | R-2 1-20 |
|---|---|---|---|---|---|---|---|---|---|---|
| D15 | 0.002 | 0.012 | 0.009 | 0.022 | 0.0011 | 0.052 | | 0.075 | 2.89 | 9.38 |
| D16 | 0.0026 | 0.011 | 0.008 | 0.028 | 0.0038 | 0.084 | | 0.17 | 3.82 | 16.3 |
| D17 | 0.002 | 0.012 | 0.01 | 0.039 | 0.0044 | 0.065 | | 0.28 | 3.25 | 35 |
| D18 | 0.0016 | 0.011 | 0.009 | 0.035 | 0.0037 | 0.043 | 0.021 | 0.017 | 2.39 | 2.66 |
| D19 | 0.0022 | 0.01 | 0.01 | 0.042 | 0.0024 | 0.058 | 0.075 | 0.082 | 2.9 | 9.32 |
| D20 | 0.0027 | 0.01 | 0.011 | 0.022 | 0.0022 | 0.064 | 0.17 | 0.15 | 5.82 | 13.9 |

Note:
R-2 = 0.25 * V/C,
R-4 = 0.5 * Cu/S

TABLE 8

| Sample No. | Mechanical properties YP (Mpa) | TS (MPa) | El (%) | r-value ($r_m$) | Δr-value (Δr) | AI (MPa) | AS (μm) | Remarks |
|---|---|---|---|---|---|---|---|---|
| D1 | 206 | 298 | 53 | 2.15 | 0.29 | 21 | 0.08 | IS |
| D2 | 189 | 312 | 52 | 2.33 | 0.38 | 18 | 0.05 | IS |
| D3 | 223 | 321 | 50 | 2.29 | 0.29 | 21 | 0.05 | IS |
| D4 | 197 | 319 | 53 | 2.23 | 0.35 | 28 | 0.07 | IS |
| D5 | 218 | 316 | 52 | 2.18 | 0.25 | 29 | 0.09 | IS |
| D6 | 189 | 296 | 54 | 2.58 | 0.79 | 46 | — | CS |
| D7 | 209 | 309 | 46 | 1.87 | 0.53 | 51 | 0.34 | CS |
| D8 | 173 | 275 | 58 | 2.62 | 1.09 | 49 | 0.49 | CS |
| D9 | 193 | 300 | 53 | 2.58 | 0.32 | 19 | 0.09 | IS |
| D10 | 211 | 310 | 52 | 2.63 | 0.35 | 25 | 0.07 | IS |
| D11 | 202 | 301 | 50 | 2.49 | 0.28 | 20 | 0.07 | IS |
| D12 | 207 | 312 | 52 | 2.53 | 0.33 | 23 | 0.07 | IS |
| D13 | 215 | 326 | 48 | 2.28 | 0.51 | 29 | 0.19 | CS |
| D14 | 173 | 289 | 53 | 2.16 | 0.24 | 0 | 0.1 | IS |
| D15 | 183 | 293 | 52 | 2.23 | 0.32 | 0 | 0.09 | IS |
| D16 | 185 | 295 | 50 | 2.19 | 0.19 | 0 | 0.08 | IS |
| D17 | 179 | 301 | 48 | 1.73 | 0.19 | 0 | 0.1 | CS |
| D18 | 166 | 285 | 53 | 2.45 | 0.41 | 0 | 0.09 | IS |
| D19 | 169 | 290 | 52 | 2.53 | 0.4 | 0 | 0.1 | IS |
| D20 | 171 | 305 | 50 | 2.49 | 0.46 | 0 | 0.08 | IS |

Note:
YP = Yield strength,
TS = Tensile strength,
El = Elongation,
r-value: Plasticity-anisotropy index,
Δr-value: In-plane anisotropy index,
AI = Aging Index,
AS = Average size of precipitates,
IS = Steel of the invention,
CS = Comparative steel

Example 2-2

High Strength CuS-Precipitated Steel with Solid Solution Strengthening

After steel slabs shown in Table 9 were reheated to a temperature of 1,200° C. followed by finish rolling the steel slabs to provide hot rolled steel sheets, the hot rolled steel sheets were cooled at a speed of 400° C./min, and wound at 650° C. Then, the wound steel sheets were sequentially subjected to cold rolling at a reduction rate of 75% followed by continuous annealing. The finish rolling was performed at 910° C., which is above the $Ar_3$ transformation temperature, and the continuous annealing was performed by heating the steel sheets to 750° C. at a speed of 10° C./second for 40 seconds.

TABLE 9

| Sample No. | Component (wt %) C ≤0.003 | P ≤0.2 | Si 0.1-0.8 | Cr 0.2-1.2 | S 0.003-0.025 | Al 0.01-0.1 | N ≤0.004 | Cu 0.01-0.2 | Mo 0.01-0.2 | V 0.01-0.2 | R-4 1-10 | R-2 1-20 |
|---|---|---|---|---|---|---|---|---|---|---|---|---|
| E1 | 0.0021 | 0.045 | | | 0.015 | 0.04 | 0.0018 | 0.045 | | | 1.5 | |
| E2 | 0.0015 | 0.048 | | | 0.013 | 0.03 | 0.0023 | 0.06 | | | 2.25 | |
| E3 | 0.0021 | 0.1 | | | 0.011 | 0.04 | 0.0015 | 0.056 | | | 2.55 | |
| E4 | 0.0025 | 0.11 | | | 0.011 | 0.04 | 0.0038 | 0.106 | | | 4.82 | |
| E5 | 0.0018 | 0.16 | | | 0.008 | 0.05 | 0.0012 | 0.141 | | | 8.81 | |

TABLE 9-continued

| Sample No. | Component (wt %) C ≤0.003 | P ≤0.2 | Si 0.1-0.8 | Cr 0.2-1.2 | S 0.003-0.025 | Al 0.01-0.1 | N ≤0.004 | Cu 0.01-0.2 | Mo 0.01-0.2 | V 0.01-0.2 | R-4 1-10 | R-2 1-20 |
|---|---|---|---|---|---|---|---|---|---|---|---|---|
| E6 | 0.0018 | 0.05 | | | 0.01 | 0.02 | 0.0039 | 0.005 | | | 0.25 | |
| E7 | 0.0022 | 0.109 | | | 0.011 | 0.05 | 0.0038 | 0.32 | | | 14.5 | |
| E8 | 0.0022 | 0.01 | 0.23 | | 0.015 | 0.04 | 0.0014 | 0.045 | | | 1.5 | |
| E9 | 0.0024 | 0.009 | 0.21 | | 0.012 | 0.05 | 0.0024 | 0.052 | | | 2.15 | |
| E10 | 0.0025 | 0.01 | 0.4 | | 0.008 | 0.04 | 0.0018 | 0.045 | | | 2.81 | |
| E11 | 0.0015 | 0.012 | 0.43 | | 0.01 | 0.04 | 0.0032 | 0.087 | | | 4.34 | |
| E12 | 0.0021 | 0.010 | 0.63 | | 0.008 | 0.035 | 0.0012 | 0.141 | | | 8.81 | |
| E13 | 0.0026 | 0.01 | 0.25 | | 0.01 | 0.03 | 0.0028 | 0.004 | | | 0.2 | |
| E14 | 0.0017 | 0.012 | 0.41 | | 0.005 | 0.04 | 0.0032 | 0.221 | | | 22.1 | |
| E15 | 0.0024 | 0.01 | | 0.30 | 0.012 | 0.04 | 0.0022 | 0.043 | | | 1.8 | |
| E16 | 0.0021 | 0.012 | | 0.33 | 0.01 | 0.04 | 0.0018 | 0.05 | | | 2.5 | |
| E17 | 0.0024 | 0.009 | | 0.60 | 0.009 | 0.05 | 0.0032 | 0.05 | | | 2.78 | |
| E18 | 0.0024 | 0.013 | | 0.63 | 0.009 | 0.04 | 0.0028 | 0.078 | | | 4.33 | |
| E19 | 0.0016 | 0.009 | | 0.95 | 0.005 | 0.04 | 0.0032 | 0.083 | | | 8.3 | |
| E20 | 0.0026 | 0.011 | | 0.35 | 0.012 | 0.04 | 0.0028 | 0.008 | | | 0.33 | |
| E21 | 0.0025 | 0.009 | | 0.61 | 0.011 | 0.05 | 0.0023 | 0.252 | | | 14 | |
| E22 | 0.0025 | 0.052 | | | 0.012 | 0.023 | 0.0033 | 0.054 | 0.035 | | 2.25 | |
| E23 | 0.0014 | 0.01 | 0.23 | | 0.009 | 0.035 | 0.0034 | 0.05 | 0.022 | | 2.78 | |
| E24 | 0.0014 | 0.011 | | 0.33 | 0.01 | 0.034 | 0.0024 | 0.04 | 0.018 | | 2 | |
| E25 | 0.0015 | 0.055 | | | 0.01 | 0.043 | 0.0023 | 0.052 | | 0.023 | 2.6 | 3.83 |
| E26 | 0.0012 | 0.009 | 0.25 | | 0.011 | 0.023 | 0.0014 | 0.055 | | 0.024 | 2.5 | 5 |
| E27 | 0.0012 | 0.01 | | 0.35 | 0.009 | 0.034 | 0.0025 | 0.042 | | 0.017 | 2.33 | 3.54 |
| E28 | 0.0024 | 0.054 | | | 0.012 | 0.034 | 0.0023 | 0.05 | 0.018 | 0.02 | 2.08 | 2.08 |
| E29 | 0.0017 | 0.01 | 0.26 | | 0.01 | 0.032 | 0.0024 | 0.05 | 0.022 | 0.018 | 2.5 | 2.65 |
| E30 | 0.0023 | 0.011 | | 0.34 | 0.01 | 0.024 | 0.0024 | 0.046 | 0.021 | 0.018 | 2.3 | 1.96 |

Note:

R-2 = 0.25 * V/C,

R-4 = 0.5 * Cu/S

TABLE 10

| Sample No. | Mechanical properties YP (MPa) | TS (MPa) | El (%) | r-value ($r_m$) | Δr-value (Δr) | AI (MPa) | DBTT (° C.) | AS (μm) | Remarks |
|---|---|---|---|---|---|---|---|---|---|
| E1 | 265 | 360 | 49 | 1.85 | 0.24 | 25 | −70 | 0.05 | IS |
| E2 | 271 | 365 | 49 | 1.83 | 0.25 | 22 | −70 | 0.05 | IS |
| E3 | 301 | 410 | 41 | 1.73 | 0.24 | 21 | −50 | 0.06 | IS |
| E4 | 299 | 402 | 42 | 1.69 | 0.22 | 27 | −50 | 0.06 | IS |
| E5 | 352 | 456 | 35 | 1.53 | 0.18 | 21 | −40 | 0.09 | IS |
| E6 | 208 | 326 | 50 | 1.85 | 0.61 | 35 | −60 | 0.38 | CS |
| E7 | 278 | 382 | 39 | 1.59 | 0.58 | 45 | −50 | 0.55 | CS |
| E8 | 270 | 355 | 52 | 1.85 | 0.28 | 21 | −80 | 0.06 | IS |
| E9 | 271 | 359 | 48 | 1.75 | 0.28 | 28 | −80 | 0.06 | IS |
| E10 | 300 | 406 | 45 | 1.68 | 0.26 | 25 | −60 | 0.07 | IS |
| E11 | 306 | 409 | 43 | 1.63 | 0.25 | 22 | −60 | 0.07 | IS |
| E12 | 363 | 459 | 35 | 1.45 | 0.21 | 26 | −50 | 0.05 | IS |
| E13 | 231 | 346 | 45 | 1.79 | 0.61 | 49 | −70 | 0.49 | CS |
| E14 | 279 | 392 | 38 | 1.66 | 0.47 | 37 | −60 | 0.51 | CS |
| E15 | 262 | 356 | 48 | 1.75 | 0.25 | 19 | −80 | 0.07 | IS |
| E16 | 265 | 350 | 48 | 1.75 | 0.23 | 17 | −80 | 0.07 | IS |
| E17 | 310 | 405 | 42 | 1.63 | 0.22 | 18 | −60 | 0.05 | IS |
| E18 | 302 | 408 | 40 | 1.58 | 0.22 | 20 | −60 | 0.05 | IS |
| E19 | 354 | 451 | 35 | 1.51 | 0.22 | 16 | −50 | 0.06 | IS |
| E20 | 212 | 339 | 47 | 1.74 | 0.49 | 37 | −70 | 0.38 | CS |
| E21 | 279 | 393 | 43 | 1.64 | 0.42 | 39 | −60 | 0.35 | CS |
| E22 | 265 | 355 | 48 | 2.18 | 0.27 | 25 | −80 | 0.06 | IS |
| E23 | 262 | 355 | 49 | 2.03 | 0.26 | 18 | −80 | 0.06 | IS |
| E24 | 252 | 356 | 47 | 2.03 | 0.31 | 15 | −80 | 0.06 | IS |
| E25 | 224 | 357 | 47 | 1.82 | 0.32 | 0 | −70 | 0.07 | IS |
| E26 | 216 | 357 | 48 | 1.77 | 0.27 | 0 | −80 | 0.07 | IS |

TABLE 10-continued

| Sample No. | Mechanical properties YP (MPa) | TS (MPa) | El (%) | r-value ($r_m$) | Δr-value (Δr) | AI (MPa) | DBTT (° C.) | AS (μm) | Remarks |
|---|---|---|---|---|---|---|---|---|---|
| E27 | 222 | 350 | 47 | 1.72 | 0.25 | 0 | −80 | 0.08 | IS |
| E28 | 210 | 361 | 48 | 2.12 | 0.38 | 0 | −70 | 0.06 | IS |
| E29 | 210 | 355 | 50 | 2.11 | 0.34 | 0 | −70 | 0.08 | IS |
| E30 | 213 | 355 | 48 | 2.14 | 0.35 | 0 | −70 | 0.08 | IS |

Note:
YP = Yield strength,
TS = Tensile strength,
El = Elongation,
r-value: Plasticity-anisotropy index,
Δr-value: In-plane anisotropy index,
AI = Aging Index,
DBTT = ductility-brittleness transition temperature for investigating secondary work embrittlement,
AS = Average size of precipitates,
IS = Steel of the invention,
CS Comparative steel

Example 2-3

High Strength CuS-Precipitated Steel with MN Precipitation Strengthening

After steel slabs shown in Table 11 were reheated to a temperature of 1,200° C. followed by finish rolling the steel slabs to provide hot rolled steel sheets, the hot rolled steel sheets were cooled at a speed of 400° C./min, and wound at 650° C. Then, the wound steel sheets were sequentially subjected to cold rolling at a reduction rate of 75% followed by continuous annealing.

The finish rolling was performed at 910° C., which is above the $Ar_3$ transformation temperature, and the continuous annealing was performed by means of heating the steel sheets to 750° C. at a speed of 10° C./second for 40 seconds. Exceptionally, in the case of the samples F8~F10, after being reheated to a temperature of 1,250° C., and then subjected to finish rolling, the samples were cooled at a speed of 550° C./minute, and were then wound at 650° C.

TABLE 11

| Sample No. | Component (wt %) C | P | S | Al | N | Cu | Mo | V | R-4 | R-3 | R-2 |
|---|---|---|---|---|---|---|---|---|---|---|---|
| Content | ≤0.003 | 0.03-0.06 | 0.003-0.025 | 0.01-0.1 | 0.005-0.02 | 0.01-0.2 | 0.01-0.2 | 0.01-0.2 | 1-10 | 1-5 | 1-20 |
| F1 | 0.0018 | 0.042 | 0.015 | 0.032 | 0.013 | 0.051 | | | 1.7 | 1.72 | |
| F2 | 0.0023 | 0.04 | 0.012 | 0.032 | 0.0097 | 0.05 | | | 2.08 | 1.72 | |
| F3 | 0.0018 | 0.042 | 0.009 | 0.042 | 0.0072 | 0.086 | | | 4.78 | 3.03 | |
| F4 | 0.0015 | 0.05 | 0.007 | 0.057 | 0.0080 | 0.123 | | | 8.79 | 3.71 | |
| F5 | 0.0025 | 0.043 | 0.01 | 0.042 | 0.0072 | 0.007 | | | 0.35 | 3.03 | |
| F6 | 0.0022 | 0.042 | 0.009 | 0.038 | 0.0014 | 0.075 | | | 4.17 | 14.1 | |
| F7 | 0.0016 | 0.04 | 0.011 | 0.008 | 0.0028 | 0.01 | | | 0.45 | 1.49 | |
| F8 | 0.0015 | 0.044 | 0.011 | 0.065 | 0.0077 | 0.037 | 0.022 | | 1.68 | 4.39 | |
| F9 | 0.0022 | 0.044 | 0.011 | 0.043 | 0.011 | 0.056 | | 0.019 | 2.55 | 2.03 | 2.16 |
| F10 | 0.0017 | 0.042 | 0.01 | 0.033 | 0.0092 | 0.035 | 0.022 | 0.017 | 1.75 | 1.87 | 2.5 |

Note:
R-2 = 0.25 * V/C,
R-3 = 0.52 * Al/N,
R-4 = 0.5 * Cu/S

TABLE 12

| Sample No. | Mechanical properties YP (MPa) | TS (MPa) | El (%) | r-value ($r_m$) | Δr-value (Δr) | AI (MPa) | DBTT (° C.) | AS (μM) | Remarks |
|---|---|---|---|---|---|---|---|---|---|
| F1 | 250 | 355 | 48 | 1.86 | 0.34 | 22 | −70 | 0.04 | IS |
| F2 | 259 | 362 | 48 | 1.82 | 0.34 | 25 | −70 | 0.04 | IS |
| F3 | 262 | 352 | 46 | 1.85 | 0.38 | 23 | −70 | 0.06 | IS |
| F4 | 255 | 348 | 48 | 1.88 | 0.35 | 22 | −70 | 0.07 | IS |
| F5 | 233 | 331 | 50 | 1.88 | 0.39 | 25 | −70 | 0.21 | CS |
| F6 | 221 | 320 | 48 | 1.83 | 0.42 | 26 | −70 | 0.18 | CS |
| F7 | 218 | 322 | 49 | 1.82 | 0.34 | 49 | −70 | 0.12 | CS |

TABLE 12-continued

| Sample No. | Mechanical properties YP (MPa) | TS (MPa) | El (%) | r-value ($r_m$) | Δr-value (Δr) | AI (MPa) | DBTT (° C.) | AS (μM) | Remarks |
|---|---|---|---|---|---|---|---|---|---|
| F8 | 202 | 357 | 48 | 2.03 | 0.33 | 18 | −70 | 0.08 | IS |
| F9 | 204 | 360 | 49 | 1.82 | 0.28 | 0 | −80 | 0.06 | IS |
| F10 | 202 | 357 | 49 | 2.23 | 0.43 | 0 | −70 | 0.07 | IS |

Note:
YP = Yield strength,
TS = Tensile strength,
El = Elongation,
r-value: Plasticity-anisotropy index,
Δr-value: In-plane anisotropy index,
AI = Aging Index,
DBTT = ductility-brittleness transition temperature for investigating secondary work embrittlement,
AS = Average size of precipitates,
IS = Steel of the invention,
CS = Comparative steel

Example 3-1

MnCu-Precipitated Steel

After steel slabs shown in Table 13 were reheated to a temperature of 1,200° C. followed by finish rolling the steel slabs to provide hot rolled steel sheets, the hot rolled steel sheets were cooled at a speed of 600° C./min, and wound at 650° C. Then, the wound steel sheets were subjected to cold rolling at a reduction rate of 75% followed by continuous annealing.

The finish rolling was performed at 910° C., which is above the $Ar_3$ transformation temperature, and the continuous annealing was performed by means of heating the steel sheets to 750° C. at a speed of 10° C./second for 40 seconds. Exceptionally, in the case of the sample G10 in Table 13, after being reheated to a temperature of 1,050° C., and then subjected to finish rolling, the samples was cooled at a speed of 50° C./minute, and was then wound at 750° C.

TABLE 13

| Sample No. | Component (wt %) C ≤0.003 | Mn 0.03-0.2 | P ≤0.015 | S 0.003-0.025 | Al 0.01-0.1 | N ≤0.004 | Cu 0.01-0.2 | Mo 0.01-0.2 | V 0.01-0.2 | R-5 ≤0.3 | R-6 2-20 | R-2 1-20 |
|---|---|---|---|---|---|---|---|---|---|---|---|---|
| G1 | 0.0021 | 0.08 | 0.012 | 0.005 | 0.04 | 0.0023 | 0.082 | | | 0.16 | 16.2 | |
| G2 | 0.0018 | 0.11 | 0.009 | 0.009 | 0.04 | 0.0019 | 0.04 | | | 0.15 | 8.33 | |
| G3 | 0.0022 | 0.09 | 0.012 | 0.011 | 0.05 | 0.0024 | 0.05 | | | 0.14 | 6.36 | |
| G4 | 0.0024 | 0.15 | 0.008 | 0.021 | 0.05 | 0.0018 | 0.04 | | | 0.19 | 4.52 | |
| G5 | 0.0022 | 0.05 | 0.008 | 0.018 | 0.04 | 0.0024 | 0.035 | | | 0.09 | 2.36 | |
| G6 | 0.0024 | 0.4 | 0.011 | 0.012 | 0.05 | 0.0038 | 0.023 | | | 0.4 | 17.6 | |
| G7 | 0.0028 | 0.05 | 0.012 | 0.018 | 0.04 | 0.0023 | 0.012 | | | 0.06 | 1.72 | |
| G8 | 0.0025 | 0.25 | 0.01 | 0.008 | 0.03 | 0.0015 | 0.18 | | | 0.4 | 26.9 | |
| G9 | 0.0022 | 0.15 | 0.013 | 0.005 | 0.03 | 0.0026 | 0.12 | | | 0.27 | 27 | |
| G10 | 0.0025 | 0.1 | 0.010 | 0.010 | 0.03 | 0.0014 | 0.042 | | | 0.14 | 7.1 | |
| G11 | 0.0023 | 0.11 | 0.01 | 0.011 | 0.024 | 0.0033 | 0.08 | 0.018 | | 0.19 | 8.64 | |
| G12 | 0.0023 | 0.12 | 0.011 | 0.009 | 0.033 | 0.0023 | 0.082 | | 0.021 | 0.20 | 11.2 | 2.28 |
| G13 | 0.0017 | 0.1 | 0.01 | 0.009 | 0.036 | 0.0032 | 0.042 | 0.019 | 0.023 | 0.14 | 7.89 | 3.38 |

Note:
R-2 = 0.25 * V/C,
R-5 = Mn + Cu,
R-6 = 0.5 * (Mn + Cu)/S

TABLE 14

| Sample No. | Mechanical properties YP (Mpa) | TS (MPa) | El (%) | r-value ($r_m$) | Δr-value (Δr) | AI (MPa) | AS (μm) | PN (number/mm$^2$) | Remarks |
|---|---|---|---|---|---|---|---|---|---|
| G1 | 198 | 292 | 51 | 2.32 | 0.38 | 17 | 0.09 | $4.5 \times 10^6$ | IS |
| G2 | 208 | 309 | 52 | 2.35 | 0.35 | 16 | 0.08 | $9.4 \times 10^6$ | IS |
| G3 | 221 | 314 | 55 | 2.51 | 0.26 | 21 | 0.06 | $2.2 \times 10^8$ | IS |
| G4 | 218 | 310 | 56 | 2.55 | 0.28 | 18 | 0.05 | $3.5 \times 10^8$ | IS |
| G5 | 205 | 300 | 58 | 2.68 | 0.31 | 23 | 0.05 | $4.1 \times 10^8$ | IS |
| G6 | 175 | 282 | 58 | 2.83 | 0.93 | 35 | 0.38 | $8.5 \times 10^4$ | CS |

TABLE 14-continued

| Sample No. | Mechanical properties YP (Mpa) | TS (MPa) | El (%) | r-value ($r_m$) | Δr-value (Δr) | AI (MPa) | AS (μm) | PN (number/mm$^2$) | Remarks |
|---|---|---|---|---|---|---|---|---|---|
| G7 | 163 | 270 | 60 | 2.78 | 1.12 | 36 | 0.48 | $4.3 \times 10^4$ | CS |
| G8 | 169 | 278 | 52 | 2.23 | 0.93 | 44 | 0.53 | $4.5 \times 10^4$ | CS |
| G9 | 189 | 286 | 51 | 1.93 | 0.79 | 42 | 0.33 | $6.3 \times 10^4$ | CS |
| G10 | 181 | 291 | 55 | 2.45 | 0.88 | 35 | 0.38 | $7.1 \times 10^4$ | CS |
| G11 | 209 | 302 | 50 | 2.83 | 0.45 | 25 | 0.09 | $3.5 \times 10^6$ | IS |
| G12 | 162 | 291 | 51 | 2.21 | 0.29 | 0 | 0.08 | $4.2 \times 10^6$ | IS |
| G13 | 159 | 298 | 53 | 2.52 | 0.39 | 0 | 0.09 | $3.2 \times 10^6$ | IS |

Note:
YP = Yield strength,
TS = Tensile strength,
El = Elongation,
r-value: Plasticity-anisotropy index,
Δr-value: In-plane anisotropy index,
AI = Aging Index,
AS = Average size of precipitates,
PN = the number of precipitates,
IS = Steel of the invention,
CS = Comparative steel

Example 3-2

High Strength MnCu-Precipitated Steel with Solid Solution Strengthening

After steel slabs shown in Table 15 were reheated to a temperature of 1,200° C. followed by finish rolling the steel slabs to provide hot rolled steel sheets, the hot rolled steel sheets were cooled at a speed of 600° C./min, and wound at 650° C. Then, the wound steel sheets were sequentially subjected to cold rolling at a reduction rate of 75% followed by continuous annealing. The finish rolling was performed at 910° C., which is above the $Ar_3$ transformation temperature, and the continuous annealing was performed by means of heating the steel sheets to 750° C. at a speed of 10° C./second for 40 seconds.

TABLE 15

| Sample No. | Component (wt %) C ≤0.003 | Mn 0.03-0.2 | P ≤0.2 | Si 0.1-0.8 | Cr 0.2-1.2 | S 0.003-0.025 | Al 0.01-0.1 | N ≤0.004 | Cu 0.01-0.2 | Mo 0.01-0.2 | V 0.01-0.2 | R-5 ≤0.3 | R-6 2-20 | R-2 1-20 |
|---|---|---|---|---|---|---|---|---|---|---|---|---|---|---|
| H1 | 0.0022 | 0.05 | 0.05 | | | 0.015 | 0.04 | 0.0018 | 0.03 | | | 0.08 | 2.67 | |
| H2 | 0.0015 | 0.08 | 0.048 | | | 0.015 | 0.03 | 0.0023 | 0.04 | | | 0.12 | 4 | |
| H3 | 0.0027 | 0.07 | 0.105 | | | 0.02 | 0.05 | 0.0019 | 0.05 | | | 0.12 | 3 | |
| H4 | 0.0025 | 0.12 | 0.11 | | | 0.011 | 0.04 | 0.0038 | 0.08 | | | 0.2 | 9.09 | |
| H5 | 0.0018 | 0.1 | 0.16 | | | 0.008 | 0.05 | 0.0012 | 0.14 | | | 0.24 | 15 | |
| H6 | 0.0018 | 0.05 | 0.05 | | | 0.015 | 0.02 | 0.0039 | 0.005 | | | 0.055 | 1.83 | |
| H7 | 0.0022 | 0.1 | 0.109 | | | 0.011 | 0.05 | 0.0038 | 0.25 | | | 0.35 | 15.9 | |
| H8 | 0.0025 | 0.2 | 0.155 | | | 0.006 | 0.05 | 0.0038 | 0.08 | | | 0.28 | 23.3 | |
| H9 | 0.0017 | 0.08 | 0.052 | | | 0.01 | 0.034 | 0.0018 | 0.043 | 0.022 | | 0.12 | 6.15 | |
| H10 | 0.0027 | 0.1 | 0.05 | | | 0.014 | 0.034 | 0.0018 | 0.043 | | 0.018 | 0.14 | 5.11 | 1.67 |
| H11 | 0.0017 | 0.11 | 0.052 | | | 0.012 | 0.024 | 0.0021 | 0.05 | 0.019 | 0.028 | 0.163 | 6.8 | 4.1 |
| H12 | 0.0021 | 0.05 | 0.009 | 0.23 | | 0.018 | 0.05 | 0.0023 | 0.03 | | | 0.08 | 2.22 | |
| H13 | 0.0026 | 0.12 | 0.01 | 0.22 | | 0.013 | 0.05 | 0.0026 | 0.03 | | | 0.15 | 5.77 | |
| H14 | 0.0016 | 0.1 | 0.012 | 0.40 | | 0.018 | 0.04 | 0.0032 | 0.05 | | | 0.15 | 4.17 | |
| H15 | 0.0021 | 0.12 | 0.012 | 0.40 | | 0.015 | 0.04 | 0.0032 | 0.08 | | | 0.2 | 6.67 | |
| H16 | 0.0021 | 0.15 | 0.010 | 0.63 | | 0.008 | 0.035 | 0.0012 | 0.141 | | | 0.291 | 18.2 | |
| H17 | 0.0016 | 0.05 | 0.009 | 0.25 | | 0.02 | 0.04 | 0.0028 | 0.005 | | | 0.055 | 1.38 | |
| H18 | 0.0021 | 0.18 | 0.011 | 0.43 | | 0.006 | 0.04 | 0.0032 | 0.1 | | | 0.28 | 23.3 | |
| H19 | 0.0022 | 0.3 | 0.009 | 0.60 | | 0.015 | 0.05 | 0.0039 | 0.23 | | | 0.53 | 17.7 | |
| H20 | 0.0025 | 0.09 | 0.011 | 0.25 | | 0.012 | 0.035 | 0.0013 | 0.032 | 0.02 | | 0.122 | 5.08 | |
| H21 | 0.002 | 0.1 | 0.01 | 0.23 | | 0.009 | 0.03 | 0.0026 | 0.043 | | 0.017 | 0.14 | 7.94 | 2.13 |
| H22 | 0.0017 | 0.11 | 0.012 | 0.25 | | 0.01 | 0.033 | 0.0036 | 0.045 | 0.018 | 0.019 | 0.16 | 7.75 | 2.79 |
| H23 | 0.0024 | 0.05 | 0.01 | | 0.30 | 0.016 | 0.04 | 0.0022 | 0.04 | | | 0.09 | 2.81 | |
| H24 | 0.0018 | 0.12 | 0.009 | | 0.32 | 0.012 | 0.05 | 0.0019 | 0.03 | | | 0.15 | 6.25 | |
| H25 | 0.0024 | 0.12 | 0.01 | | 0.6 | 0.015 | 0.04 | 0.0025 | 0.05 | | | 0.17 | 5.67 | |
| H26 | 0.0027 | 0.1 | 0.01 | | 0.63 | 0.018 | 0.04 | 0.0025 | 0.04 | | | 0.14 | 3.89 | |
| H27 | 0.0026 | 0.18 | 0.009 | | 0.95 | 0.008 | 0.05 | 0.0022 | 0.08 | | | 0.26 | 16.3 | |
| H28 | 0.0017 | 0.05 | 0.01 | | 0.32 | 0.02 | 0.04 | 0.0022 | 0.01 | | | 0.06 | 1.5 | |
| H29 | 0.0023 | 0.15 | 0.01 | | 0.62 | 0.005 | 0.05 | 0.0023 | 0.12 | | | 0.27 | 27 | |
| H30 | 0.0025 | 0.25 | 0.012 | | 0.93 | 0.015 | 0.04 | 0.0024 | 0.29 | | | 0.54 | 18 | |

TABLE 15-continued

| Sample No. | Component (wt %) | | | | | | | | | | | | | |
|---|---|---|---|---|---|---|---|---|---|---|---|---|---|---|
| | C | Mn | P | Si | Cr | S | Al | N | Cu | Mo | V | R-5 | R-6 | R-2 |
| | ≤0.003 | 0.03-0.2 | ≤0.2 | 0.1-0.8 | 0.2-1.2 | 0.003-0.025 | 0.01-0.1 | ≤0.004 | 0.01-0.2 | 0.01-0.2 | 0.01-0.2 | ≤0.3 | 2-20 | 1-20 |
| H31 | 0.0017 | 0.11 | 0.011 | | 0.34 | 0.013 | 0.034 | 0.0029 | 0.043 | 0.018 | | 0.15 | 5.88 | |
| H32 | 0.0016 | 0.09 | 0.01 | | 0.32 | 0.036 | 0.0022 | 0.038 | 0.016 | | 0.13 | 5.33 | 2.5 | |
| H33 | 0.0018 | 0.1 | 0.012 | | 0.34 | 0.01 | 0.026 | 0.0025 | 0.043 | 0.022 | 0.016 | 0.14 | 7.15 | 2.22 |

Note:
R-2 = 0.25 * V/C,
R-5 = Mn + Cu,
R-6 = 0.5 * (Mn + Cu)/S

TABLE 16

| Sample No. | Mechanical properties | | | | | | | PN | | |
|---|---|---|---|---|---|---|---|---|---|---|
| | YP (MPa) | TS (MPa) | El (%) | r-value ($r_m$) | Δr-value (Δr) | AI (MPa) | DBTT (° C.) | AS (μm) | (number/mm$^2$) | Remarks |
| H1 | 265 | 360 | 52 | 1.93 | 0.28 | 19 | −70 | 0.05 | $4.5 \times 10^8$ | IS |
| H2 | 255 | 358 | 53 | 2.09 | 0.28 | 14 | −70 | 0.07 | $2.0 \times 10^8$ | IS |
| H3 | 302 | 405 | 45 | 1.79 | 0.22 | 17 | −60 | 0.06 | $4.2 \times 10^8$ | IS |
| H4 | 289 | 392 | 46 | 1.70 | 0.29 | 19 | −50 | 0.06 | $7.5 \times 10^6$ | IS |
| H5 | 350 | 452 | 37 | 1.63 | 0.21 | 13 | −40 | 0.09 | $2.3 \times 10^6$ | IS |
| H6 | 228 | 327 | 47 | 1.75 | 0.65 | 38 | −50 | 0.38 | $8.3 \times 10^3$ | CS |
| H7 | 282 | 385 | 39 | 1.59 | 0.55 | 45 | −50 | 0.55 | $3.5 \times 10^4$ | CS |
| H8 | 341 | 444 | 33 | 1.41 | 0.43 | 35 | −40 | 0.61 | $2.3 \times 10^4$ | CS |
| H9 | 256 | 358 | 51 | 2.32 | 0.29 | 19 | −70 | 0.06 | $6.5 \times 10^8$ | IS |
| H10 | 204 | 362 | 50 | 1.89 | 0.21 | 0 | −60 | 0.06 | $5.5 \times 10^8$ | IS |
| H11 | 213 | 366 | 49 | 2.31 | 2.8 | 0 | −60 | 0.07 | $5.0 \times 10^8$ | IS |
| H12 | 251 | 355 | 54 | 1.95 | 0.28 | 13 | −80 | 0.07 | $4.9 \times 10^8$ | IS |
| H13 | 245 | 350 | 54 | 1.97 | 0.28 | 20 | −80 | 0.14 | $8.5 \times 10^6$ | IS |
| H14 | 296 | 405 | 45 | 1.73 | 0.25 | 13 | −60 | 0.09 | $3.2 \times 10^8$ | IS |
| H15 | 305 | 405 | 44 | 1.79 | 0.22 | 18 | −60 | 0.07 | $4.1 \times 10^8$ | IS |
| H16 | 365 | 465 | 37 | 1.55 | 0.21 | 18 | −50 | 0.17 | $2.2 \times 10^6$ | IS |
| H17 | 231 | 336 | 45 | 1.79 | 0.61 | 42 | −70 | 0.49 | $3.2 \times 10^4$ | CS |
| H18 | 279 | 382 | 40 | 1.63 | 0.57 | 40 | −60 | 0.51 | $9.3 \times 10^4$ | CS |
| H19 | 331 | 445 | 32 | 1.37 | 0.22 | 42 | −40 | 0.43 | $6.7 \times 10^4$ | CS |
| H20 | 260 | 362 | 52 | 2.35 | 0.28 | 26 | −80 | 0.07 | $3.8 \times 10^8$ | IS |
| H21 | 208 | 360 | 50 | 1.89 | 0.23 | 0 | −70 | 0.08 | $3.5 \times 10^8$ | IS |
| H22 | 203 | 352 | 51 | 2.21 | 0.27 | 0 | −70 | 0.07 | $2.5 \times 10^8$ | IS |
| H23 | 265 | 356 | 52 | 1.93 | 0.22 | 23 | −80 | 0.06 | $5.9 \times 10^8$ | IS |
| H24 | 258 | 352 | 54 | 1.95 | 0.29 | 27 | −70 | 0.07 | $4.4 \times 10^8$ | IS |
| H25 | 298 | 395 | 45 | 1.62 | 0.22 | 22 | −60 | 0.05 | $6.2 \times 10^8$ | IS |
| H26 | 302 | 405 | 46 | 1.58 | 0.20 | 23 | −60 | 0.05 | $6.1 \times 10^8$ | IS |
| H27 | 348 | 455 | 38 | 1.55 | 0.22 | 21 | −50 | 0.06 | $2.2 \times 10^6$ | IS |
| H28 | 237 | 342 | 45 | 1.65 | 0.52 | 43 | −70 | 0.35 | $4.2 \times 10^4$ | CS |
| H29 | 275 | 390 | 41 | 1.54 | 0.42 | 42 | −60 | 0.55 | $7.3 \times 10^4$ | CS |
| H30 | 335 | 440 | 32 | 1.38 | 0.25 | 38 | −40 | 0.42 | $5.7 \times 10^4$ | CS |
| H31 | 258 | 359 | 51 | 2.38 | 0.37 | 19 | −80 | 0.07 | $6.9 \times 10^8$ | IS |
| H32 | 210 | 352 | 52 | 1.9 | 0.22 | 0 | −70 | 0.07 | $5.6 \times 10^8$ | IS |
| H33 | 204 | 349 | 52 | 2.21 | 0.36 | 0 | −70 | 0.08 | $4.2 \times 10^8$ | IS |

Note:
YP = Yield strength,
TS = Tensile strength,
El = Elongation,
r-value: Plasticity-anisotropy index,
Δr-value: In-plane anisotropy index,
AI = Aging Index,
DBTT = Ductility-brittleness transition temperature for investigating secondary work embrittlement,
AS = Average size of precipitates,
PN = The number of precipitates,
IS = Steel of the invention,
CS = Comparative steel

Example 3-3

High Strength MnCu-Precipitated Steel with AlN Precipitation Strengthening

After steel slabs shown in Table 17 were reheated to a temperature of 1,200° C. followed by finish rolling the steel slabs to provide hot rolled steel sheets, the hot rolled steel sheets were cooled at a speed of 400° C./min, and wound at 650° C. Then, the wound steel sheets were sequentially subjected to cold rolling at a reduction rate of 75% followed by continuous annealing. The finish rolling was performed at 910° C., which is above the $Ar_3$ transformation temperature, and the continuous annealing was performed by means of heating the steel sheets to 750° C. at a speed of 10° C./second for 40 seconds.

TABLE 17

| Sample No. | C ≤0.003 | Mn 0.03-0.2 | P 0.03-0.06 | S 0.003-0.025 | Al 0.01-0.1 | N 0.005-0.02 | Cu 0.01-0.2 | Mo 0.01-0.2 | V 0.01-0.2 | R-5 ≤0.3 | R-6 2-20 | R-3 1-5 | R-2 1-20 |
|---|---|---|---|---|---|---|---|---|---|---|---|---|---|
| I1 | 0.0023 | 0.05 | 0.04 | 0.015 | 0.032 | 0.0097 | 0.03 | — | — | 0.08 | 2.67 | 1.72 | — |
| I2 | 0.0018 | 0.1 | 0.042 | 0.012 | 0.042 | 0.0072 | 0.03 | — | — | 0.13 | 5.42 | 3.03 | — |
| I3 | 0.0021 | 0.1 | 0.05 | 0.01 | 0.057 | 0.0080 | 0.08 | — | — | 0.18 | 9 | 3.71 | — |
| I4 | 0.0025 | 0.15 | 0.05 | 0.008 | 0.065 | 0.0075 | 0.1 | — | — | 0.25 | 15.63 | 4.51 | — |
| I5 | 0.0025 | 0.05 | 0.045 | 0.017 | 0.042 | 0.0072 | 0.01 | — | — | 0.06 | 1.76 | 3.03 | — |
| I6 | 0.0022 | 0.15 | 0.04 | 0.009 | 0.038 | 0.0014 | 0.05 | — | — | 0.2 | 11.1 | 14.1 | — |
| I7 | 0.0016 | 0.15 | 0.05 | 0.005 | 0.05 | 0.0070 | 0.2 | — | — | 0.35 | 35 | 3.71 | — |
| I8 | 0.0015 | 0.12 | 0.044 | 0.012 | 0.051 | 0.011 | 0.038 | 0.019 | — | 0.16 | 6.58 | 2.41 | — |
| I9 | 0.0018 | 0.1 | 0.041 | 0.009 | 0.045 | 0.0095 | 0.039 | — | 0.02 | 0.14 | 7.72 | 2.46 | 2.78 |
| I10 | 0.0016 | 0.11 | 0.042 | 0.01 | 0.042 | 0.01 | 0.049 | 0.018 | 0.016 | 0.16 | 7.95 | 2.18 | 2.5 |

Note:
R-2 = 0.25 * V/C,
R-3 = 0.52 * Al/N,
R-5 = Mn + Cu,
R-6 = 0.5 * (Mn + Cu)/S

TABLE 18

| | Mechanical properties | | | | | | | | PN | |
|---|---|---|---|---|---|---|---|---|---|---|
| Sample No. | YP (MPa) | TS (MPa) | El (%) | r-value ($r_m$) | Δr-value (Δr) | AI (MPa) | DBTT (° C.) | AS (μm) | (number/ $mm^2$) | Remarks |
| I1 | 246 | 352 | 54 | 1.96 | 0.29 | 22 | −70 | 0.04 | $4.9 \times 10^8$ | IS |
| I2 | 252 | 356 | 53 | 1.94 | 0.28 | 25 | −70 | 0.05 | $3.5 \times 10^8$ | IS |
| I3 | 250 | 348 | 50 | 1.89 | 0.32 | 27 | −60 | 0.07 | $3.2 \times 10^6$ | IS |
| I4 | 255 | 350 | 48 | 1.86 | 0.35 | 22 | −60 | 0.09 | $4.1 \times 10^6$ | IS |
| I5 | 243 | 340 | 43 | 1.68 | 0.39 | 36 | −70 | 0.21 | $9.2 \times 10^4$ | CS |
| I6 | 223 | 328 | 48 | 1.89 | 0.32 | 27 | −70 | 0.09 | $9.3 \times 10^6$ | CS |
| I7 | 238 | 342 | 43 | 1.72 | 0.34 | 38 | −70 | 0.32 | $9.3 \times 10^4$ | CS |
| I8 | 244 | 350 | 54 | 2.32 | 0.39 | 18 | −70 | 0.05 | $5.2 \times 10^8$ | IS |
| I9 | 195 | 349 | 53 | 1.93 | 0.21 | 0 | −70 | 0.05 | $4.5 \times 10^8$ | IS |
| I10 | 193 | 345 | 53 | 2.32 | 0.35 | 0 | −70 | 0.06 | $4.8 \times 10^8$ | IS |

Note:
YP = Yield strength,
TS = Tensile strength,
El = Elongation,
r-value: Plasticity-anisotropy index,
Δr-value: In-plane anisotropy index,
AI = Aging Index,
DBTT = ductility-brittleness transition temperature for investigating secondary work embrittlement,
AS = Average size of precipitates,
PN = The number of precipitates,
IS = Steel of the invention,
CS = Comparative steel Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A cold rolled steel sheet for an automobile having aging resistance, comprising in weight %: 0.003% or less of C; 0.005~0.03% of S; 0.01~0.1% of Al; 0.02% or less of N; 0.2% or less of P; 0.05~0.2% of Mn; 0.2~1.2% Cr and the balance of Fe and other unavoidable impurities, wherein a composition of Mn and S satisfies the relationship: 0.58*Mn/S≤10, wherein the steel sheet comprises precipitates of MnS having an average size of 0.2 μm or less, and wherein the steel has a yield strength of 197 MPa or more, an $r_m$-value of 1.47 or more, and an aging index of 27 MPa or less.

2. The steel sheet as set forth in claim 1, wherein the steel sheet comprises 0.004% or less of N.

3. The steel sheet as set forth in claim 1, further comprising 0.1~0.8% of Si.

4. The steel sheet as set forth in claim 3, further comprising 0.01~0.2% of Mo.

5. The steel sheet as set forth in claim 4, further comprising 0.01~0.2% of V.

6. The steel sheet as set forth claim 3, further comprising 0.01~0.2% of V.

7. The steel sheet as set forth in claim 1, wherein the steel sheet comprises 0.005~0.02% of N and 0.03~0.06% of P.

8. The steel sheet as set forth in claim 7, wherein the composition of Al and N satisfies the relationship: 1≤0.52*Al/N≤5.

9. The steel sheet as set forth in claim 1, further comprising 0.01~0.2% of Mo.

10. The steel sheet as set forth in claim 1, further comprising 0.01~0.2% of V.

11. The steel sheet as set forth in claim 10, wherein the composition of V and C satisfies the relationship: 1≤0.25*V/C≤20.

12. The steel sheet as set forth in claim 1, wherein the steel sheet comprises 0.015% or less of P.

13. The steel sheet as set forth in claim 1, wherein the steel sheet comprises 0.03~0.2% of P.

14. A cold rolled steel sheet for an automobile having aging resistance comprising in weight %: 0.0005~0.003% of C; 0.003~0.025% of S; 0.01~0.08% of Al; 0.02% or less of N; 0.2% or less of P; 0.052~0.2% of Cu; and the balance of Fe and other unavoidable impurities, wherein a composition of Cu and S satisfies the relationship: $1 \leq 0.5*Cu/S \leq 10$, wherein the steel sheet comprises precipitates of CuS having an average size of 0.1 μm or less, and wherein the steel has a yield strength of 166 MPa or more, an $r_m$-value of 1.45 or more, and an aging index of 28 MPa or less.

15. The steel sheet as set forth in claim 14, wherein the steel sheet comprises 0.015% or less of P.

16. The steel sheet as set forth in claim 14, wherein the steel sheet comprises 0.004% or less of N.

17. The steel sheet as set forth in claim 14, wherein the composition of Cu and S satisfies the relationship: $1 \leq 0.5*Cu/S \leq 3$.

18. The steel sheet as set forth in claim 14, wherein the steel sheet comprises 0.03~0.2% of P.

19. The steel sheet as set forth in claim 14, further comprising 0.2~1.2% of Cr.

20. The steel sheet as set forth in claim 19, further comprising 0.01~0.2% of Mo.

21. The steel sheet as set forth in claim 20, further comprising 0.01~0.2% of V.

22. The steel sheet as set forth claim 19, further comprising 0.01~0.2% of V.

23. The steel sheet as set forth in claim 14, wherein the steel sheet comprises 0.005~0.02% of N and 0.03~0.06% of P.

24. The steel sheet as set forth in claim 23, wherein the composition of Al and N satisfies the relationship: $10.52*Al/N \leq 5$.

25. The steel sheet as set forth in claim 14, further comprising 0.01~0.2% of Mo.

26. The steel sheet as set forth in claim 14, further comprising 0.01~0.2% of V.

27. The steel sheet as set forth in claim 26, wherein the composition of V and C satisfies the relationship: $1 \leq 0.25*V/C \leq 20$.

28. A cold rolled steel sheet for an automobile having aging resistance, comprising in weight %: 0.0005~0.003% of C; 0.003~0.025% of S; 0.01~0.08% of Al; 0.02% or less of N; 0.2% or less of P; 0.03~0.2% of Mn; 0.005~0.2% of Cu; and the balance of Fe and other unavoidable impurities, wherein a composition of Mn, Cu, and S satisfies the relationship: $Mn+Cu \leq 0.3$ and $2 \leq 0.5*(Mn+Cu)/S \leq 20$, wherein the steel sheet includes precipitates of MnS, CuS, and (Mn, Cu)S having an average size of 0.2 μm or less, wherein the steel sheet has an Aging Index (AI) of 30 MPa or less, and wherein the steel sheet has a yield strength of 162 MPa or more and an $r_m$-value of 1.55 or more.

29. The steel sheet as set forth in claim 28, wherein the steel sheet comprises 0.015% or less of P.

30. The steel sheet as set forth in claim 28, wherein the steel sheet comprises 0.004% or less of N.

31. The steel sheet as set forth in claim 28, wherein the composition of Mn, Cu and S satisfies the relationship: $2 \leq 0.5*(Mn+Cu)/S \leq 7$.

32. The steel sheet as set forth in claim 31, wherein the steel sheet comprises 0.03~0.2% of P.

33. The steel sheet as set forth in claim 31, further comprising at least one of 0.1~0.8% of Si and 0.2~1.2% of Cr.

34. The steel sheet as set forth in claim 33, further comprising 0.01~0.2% of V.

35. The steel sheet as set forth claim 33, further comprising 0.01~0.2% of V.

36. The steel sheet as set forth in claim 31, wherein the steel sheet comprises 0.005~0.02% of N and 0.03~0.06% of P.

37. The steel sheet as set forth in claim 36, wherein the composition of Al and N satisfies the relationship: $1\ 0.52*Al/N \leq 5$.

38. The steel sheet as set forth in claim 28, further comprising 0.01~0.2% of Mo.

39. The steel sheet as set forth in claim 38, further comprising 0.01~0.2% of V.

40. The steel sheet as set forth in claim 28, further comprising 0.01~0.2% of V.

41. The steel sheet as set forth in claim 40, wherein the composition of V and C satisfies the relationship: $1 \leq 0.25*V/C \leq 20$.

* * * * *

UNITED STATES PATENT AND TRADEMARK OFFICE

CERTIFICATE OF CORRECTION

PATENT NO. : 9,297,057 B2
APPLICATION NO. : 10/578737
DATED : March 29, 2016
INVENTOR(S) : Yoon et al.

It is certified that error appears in the above-identified patent and that said Letters Patent is hereby corrected as shown below:

In the claims

Column 34, Line 50, Claim 6, before "claim" insert -- in --

Column 35, Line 26, Claim 22, before "claim" insert -- in --

Column 35, Line 31, Claim 24, delete "10.52" and insert -- 1≤0.52 --

Column 36, Line 24, Claim 35, before "claim" insert -- in --

Column 36, Line 30, Claim 37, delete "1 0.52" and insert -- 1≤0.52 --

Signed and Sealed this
Twenty-eighth Day of June, 2016

Michelle K. Lee

Michelle K. Lee
*Director of the United States Patent and Trademark Office*